US006382754B1

(12) United States Patent
Morikoshi et al.

(10) Patent No.: US 6,382,754 B1
(45) Date of Patent: May 7, 2002

(54) INK JET PRINTING DEVICE

(75) Inventors: Koji Morikoshi, Suwa; Tsuyoshi Kitahara, Nagano; Kaoru Momose, Nagano; Noriaki Okazawa, Nagano; Masahiko Yoshida, Nagano; Kazunaga Suzuki, Nagano; Takahiro Katakura, Nagano; Toshiki Usui, Nagano, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/695,303

(22) Filed: Oct. 25, 2000

Related U.S. Application Data

(60) Division of application No. 08/890,040, filed on Jul. 9, 1997, now Pat. No. 6,217,159, which is a continuation-in-part of application No. 08/859,342, filed on May 20, 1997, now abandoned, which is a continuation-in-part of application No. 08/635,196, filed on Apr. 19, 1996, now abandoned.

(30) Foreign Application Priority Data

| | | |
|---|---|---|
| Apr. 21, 1995 | (JP) | 7-97239 |
| Apr. 21, 1995 | (JP) | 7-97240 |
| Jun. 8, 1995 | (JP) | 7-166969 |
| Jun. 8, 1995 | (JP) | 7-166970 |
| Jun. 8, 1995 | (JP) | 7-166971 |
| Apr. 5, 1996 | (JP) | 8-110384 |
| May 20, 1996 | (JP) | 8-148680 |
| Jul. 9, 1996 | (JP) | 8-179622 |

(51) Int. Cl.[7] ..... B41J 29/38

(52) U.S. Cl. ..... 347/11; 347/10

(58) Field of Search ..... 347/9–11

(56) References Cited

U.S. PATENT DOCUMENTS 4,266,232 A 5/1981 Juliana, Jr. et al. ..... 347/68
4,672,398 A 6/1987 Kuwabara et al. ..... 347/11

(List continued on next page.)

FOREIGN PATENT DOCUMENTS

EP 0 208 484 1/1987 ..... B41J/2/055
EP 0 271 905 6/1988 ..... B41J/3/04

(List continued on next page.)

OTHER PUBLICATIONS

Patent Abstracts of Japan, Publication No. 6171080, dated Jun. 21, 1994.
Patent Abstracts of Japan, Publication No. 59176055, dated Oct. 05, 1984.
Patent Abstracts of Japan, Publication No. 03222750, dated Oct. 01, 1991.

*Primary Examiner*—John E. Barlow, Jr.
*Assistant Examiner*—Alfred E. Dudding
(74) *Attorney, Agent, or Firm*—Sughrue Mion, PLLC

(57) ABSTRACT

An ink jet printing device supplies first and second signals to cause a pressure generating chamber to jet out ink droplets. A third signal is applied to the pressure generating chamber to effectively attenuate the kinetic energy of the meniscus and to hold the meniscus at a position suitable for jetting out the next ink droplet to provide a stable print output. Also, an ink-jet recording apparatus is provided with a control means for controlling the timing of the start of the second signal and the timing of the start of the third signal according to the environmental temperature. In the ink-jet recording apparatus, the discharge speed of ink drops is made constant by regulating the start time of the second signal so as to make constant the drawing position of a meniscus when the ink drops are discharged. Further, the pressure generating chamber is expanded again by applying the third signal at the time the vibration of the meniscus generated by the discharge of the ink drops is moved closest to the pressure generating chamber, so that the kinetic energy of the meniscus moving to the nozzle can effectively be attenuated.

66 Claims, 29 Drawing Sheets

U.S. PATENT DOCUMENTS

| | | | | | |
|---|---|---|---|---|---|
| 4,972,211 | A | | 11/1990 | Aoki | 347/11 |
| 5,146,236 | A | | 9/1992 | Hirata et al. | 347/12 |
| 5,477,245 | A | | 12/1995 | Fuse | 347/10 |
| 5,541,628 | A | | 7/1996 | Chang et al. | 347/10 |
| 5,754,204 | A | | 5/1998 | Kitahara | 347/70 |
| 6,095,630 | A | * | 8/2000 | Horii et al. | 347/10 |

FOREIGN PATENT DOCUMENTS

| | | | |
|---|---|---|---|
| EP | 0 278 589 | 8/1988 | B41J/3/04 |
| EP | 0 354 706 | 2/1990 | B41J/2/175 |
| EP | 0 467 656 | 1/1992 | B41J/2/045 |
| EP | 0 531 173 | 3/1993 | B41J/2/015 |
| EP | 0 541 129 | 5/1993 | B41J/2/049 |
| EP | 0 548 984 | 6/1993 | B41J/2/045 |
| EP | 0 574 016 | 12/1993 | B41J/2/015 |
| EP | 0 580 154 | 1/1994 | B41J/2/049 |
| EP | 0 596 530 | 5/1994 | B41J/2/025 |
| EP | 0 608 835 | 8/1994 | B41J/2/045 |
| EP | 0 616 891 | 9/1994 | B41J/2/045 |
| EP | 0 648 606 | 4/1995 | B41J/2/045 |
| WO | PCT 9 426 522 | 11/1994 | B41J/2/045 |
| WO | PCT 9 516 568 | 6/1995 | B41J/2/045 |
| WO | PCT 9 534 427 | 12/1995 | B41J/2/045 |

* cited by examiner

FIG. 28(a)

pw5 = (pw1 + pwh1) = (15 + 10) = 25 μs

EXPELLING SPEED (m/s)

| NOZZLE DIAMETER (μm) | 23 | 24 | 25 | 26 |
|---|---|---|---|---|
| 37 | 9.1 | 8.4 | 8.1 | |
| 36 | 9.4 | 9.3 | 8.5 | |
| 35 | 10.2 | 9.6 | 9.0 | |
| 34 | 11.7 | 10.1 | 9.9 | |
| 33 | | | | |

WIDTH OF INK SUPPLY PORTS (μm)

FIG. 28(b)

pw5 = (pw1 + pwh1) = (15 + 20) = 35 μs

EXPELLING SPEED (m/s)

| NOZZLE DIAMETER (μm) | 23 | 24 | 25 | 26 |
|---|---|---|---|---|
| 37 | 7.9 | 7.4 | 6.7 | |
| 36 | 8.5 | 7.8 | 7.4 | |
| 35 | 8.7 | 8.4 | 8.2 | |
| 34 | 9.0 | 9.0 | 9.1 | |
| 33 | | | | |

WIDTH OF INK SUPPLY PORTS (μm)

INK JET PRINTING DEVICE

This is a divisional of application Ser. No. 08/890,040 filed Jul. 9, 1997, U.S. Pat. No. 6,217,159 which in turn was a continuation-In-Part of application Ser. No. 08/859,342 filed May 20, 1997, abandoned which was a Continuation-In-Part of application Ser. No. 08/635,196 filed Apr. 19, 1996, abandoned the disclosure of which is incorporated herein by reference.

BACKGROUND OF THE INVENTION

Field of the Invention

The present invention relates to an ink jet print head having an actuator which consists of a longitudinal vibration mode piezoelectric vibrator.

Related Art

A conventional on-demand type ink-jet recording head comprises a plurality of pressure generating chambers for generating ink pressure by means of piezo-electric vibrators and heating elements. A common ink chamber supplies ink to each of the pressure generating chambers via a flow channel for each respective pressure generating chamber. Each pressure generating chamber communicates with a nozzle so that the ink-jet recording head can send a stream of ink drops from each nozzle to a recording medium in accordance with a driving signal to the pressure generating chambers. The driving signal corresponds to a print signal.

In a first conventional ink-jet recording head, a resistive wire for generating Joule heat is provided in the pressure generating chamber as the pressure generating means for causing ink drops to be discharged through the nozzle. This conventional device makes use of bubble generating pressure and is known as a bubble-jet type print device.

On the other hand, a high speed drive actuator for an ink jet print head expands and compresses a pressure generating chamber to suck in ink and to form ink droplets. The actuator is constructed with a piezoelectric vibrator having a longitudinal vibration mode, which is expandable in its axial direction and has a structure consisting of piezoelectric sheet-like members and conductive sheet-like members, alternately layered one on another. A part of the pressure generating chamber is formed with an elastic plate, and the chamber communicates with a nozzle hole associated therewith.

Although the bubble-jet type head makes it feasible to readily provide an inexpensive, high-density apparatus, the heat generation causes the deterioration of ink and the head itself. By contrast, the piezoelectric type features no ink deterioration because heat generation is not a factor. Therefore, a wide range of inks may be used, and lower operating costs result because the life of the head is semi-permanent. Moreover, the high-speed driving of the piezo-electric vibrator having the vertical vibration mode, and the alternate repetition of the expansion and contraction of the pressure generating chamber by bringing the piezo-electric vibrator into contact with the pressure generating chamber allows the piezo-electric type print head provide higher speed printing than the bubble-jet type.

Further, when the longitudinal vibration mode piezoelectric vibrator is compared with a piezoelectric vibrator of the type in which the surface thereof is bent for vibration, the former has a smaller contact area where it contacts with the pressure generating chamber than the latter, and may be driven at higher speed than the latter. Accordingly, the former is capable of performing the printing operation at a higher speed and also at higher resolution. Therefore, while both types of piezo-electric vibration modes may be used, the longitudinal type is preferable.

While the longitudinal vibration mode piezoelectric vibrator may be driven at high speed, the attenuation rate of the residual vibration is small. This is because fluctuations in pressure remain in the chamber even after the pressure is generated in the chamber to discharge ink drops. After discharge, an ink meniscus within the nozzle recovers toward the tip of the nozzle at a resonance period (Helmholtz resonance period) specific to the materials and dimensions of pressure generating chamber. As a result, a large vibration is left after an ink droplet is shot forth.

Because the residual vibration affects the behavior of the meniscus, the position of the meniscus is indefinite when the next ink droplet is to be jet out. This may be explained by the fact that the period of the residual vibration is minute and shorter than the time required for the meniscus to reach the tip of the nozzle (the time is hereinafter called the "recovery time" of the meniscus). When high-frequency driving is carried out, the discharged ink drops may become unstable because the meniscus is insecure if ink drops are caused to be discharged before the minute residual vibration is sufficiently settled. Consequently, the direction in which the ink drops are jetted from the nozzle varies, and ink misting occurs when the meniscus overshoots the nozzle. The result is deterioration of the print quality. This hampers improvements in the response frequency of the ink jet recording head.

The vibration behavior of the meniscus varies not only with dimensional variations in the flow channel but also varies with the physical properties of material and ink. The environmental temperature makes the meniscus behavior vary further. Thus, the residual vibration of the meniscus cannot effectively controlled by a fixed driving method. Because many variables must be considered, the production cost increases. In addition, freedom in design is reduced because the dimensions of the flow channel need severe control, and less latitude is allowed in selecting material for use in forming the flow channel and for ink selection.

In addition, there arises the following problems. When the pressure generating chamber is expanded, the meniscus within the nozzle is drawn to the pressure generating chamber side. However, the meniscus is gradually recovered toward the tip of the nozzle as ink is gradually supplied into the pressure generating chamber. The discharge speed of ink drops is made constant by causing ink to be discharged after the meniscus reaches the tip of the nozzle, irrespective of the discharge timing. When the high-frequency driving is carried out, however, the ink has to be discharged before the meniscus thus drawn satisfactorily reaches the tip of the nozzle, depending on the recovery time of the meniscus since the expansion and contraction of the pressure chamber need to be carried out at short lead time.

Moreover, it is preferred to have the ink discharged in such a state that the meniscus has been drawn in to a certain degree in order to secure the discharge speed of ink drops and a stable discharge of ink.

The drawn quantity of the meniscus and the recovery time up to the tip of the nozzle vary with the dimensions of the flow channel and the physical properties of material and ink, similar to the meniscus vibration after the ink is discharged. Consequently, the method of causing ink to be discharged at fixed timing produces variation in the drawing position of the meniscus at the time of discharging ink. This varies the discharge speed of ink drops and the discharge quantity of ink. As set forth above, to maintain consistent print quality taking into account these factors, the production cost increases, whereas freedom of design is reduced because the dimensions of the flow channel need severe control, and less latitude is allowed in selecting material for use in forming the flow channel and also for ink selection.

SUMMARY OF THE INVENTION

The present invention overcomes the problems noted above. An object of the present invention is to provide an ink jet printing device which is driven at high speed while being free from the generation of ink mist and the bending of the flying path of the ink droplet. Such a printing device offers stable images even at high drawing frequencies by maintaining a constant ink discharge speed. This ensures consistent positioning of the ink spots.

A second object of the present invention is to provide an ink jet printing device which is capable of changing dot size while maintaining print quality.

A third object of the present invention is to provide an ink jet printing device which is driven at a preset drive frequency independently of the specifications of the print head and ambient temperature, and which is free from the generation of ink mist and the bending of a flying path of the ink droplet.

A fourth object of the present invention is to provide an ink jet printing device which is driven according to dimensions of the ink flow channels, physical properties of the material and ink, and environmental temperature.

To solve the problems referred to above, the present invention comprises: an ink jet print head having pressure generating chambers each including a nozzle hole and each communicating with a common ink chamber, the pressure generating chambers each having a Helmholtz resonance frequency of period TH and communicating through an ink supplying path, and a piezoelectric vibrator for expanding and compressing said pressure generating chambers; and drive signal generating means for generating a first signal to expand said pressure generating chambers, a second signal to compress said pressure generating chambers being in an expanded state to compel said pressure generating chamber to shoot forth an ink droplet through said nozzle hole, and a third signal to expand said pressure generating chambers by a volume smaller than the volume expanded by said first signal when the vibration of the meniscus generated after the shooting of an ink droplet moves to the nozzle hole. The first through third signals may be in the form of pulses.

In another embodiment of the invention, the printing device further includes a drive signal generating control means to selectively control the timing for the start of the second and third pulses.

The timing of the start of the second signal is controlled by the drive signal generating control means so that the position of a meniscus in the nozzle at the timing of starting the second pulse is made constant. The drive signal generating control means sets the timing of the start of the second signal as desired according to the flow-channel impedance of the nozzle and the ink supply port. The timing of the start of the second signal is set fast when the flow-channel impedance of the nozzle or the ink supply port is low, whereas the timing thereof is set slow when the flow-channel impedance thereof is high. The timing of the start of the second signal is set fast when the sectional area of the nozzle or the ink supply port is large, whereas the timing thereof is set slow when the sectional area thereof is small. The timing of the start of the second signal is set fast when the nozzle or the ink supply port is long, whereas the timing thereof is set slow when the nozzle or the ink supply port is short.

The ink-jet recording apparatus further comprises an environmental temperature detection means, so that the timing of the start of the second signal is controlled by the drive signal generating control means according to the environmental temperature. The timing of the start of the second signal is set fast when the environmental temperature rises, whereas the timing thereof is set slow when the environmental temperature lowers.

When the vibration of the meniscus generated by the shooting of an ink droplet moves toward the nozzle hole, the pressure generating chamber receives the third signal to minutely expand the pressure generating chamber to effectively attenuate the vibration of the meniscus, and to stay the meniscus at a position suitable for jetting out the next ink droplet.

The timing of the start of the third signal is controlled by the drive signal generating control means so that the vibration of the meniscus generated after the ink drops are discharged substantially conforms to the vibration thereof at a point of time the meniscus is moved closest to the pressure generating chamber.

The ink-jet recording apparatus further comprises the drive signal generating control means for selectively setting the timing of starting the third signal according to the Helmholtz period TH of the pressure generating chamber. The duration of the second signal is set substantially equal to the duration of the third signal and the time from the start of the second signal up to the start of the third signal is set to substantially conform to the Helmholtz period TH of the pressure generating chamber.

BRIEF DESCRIPTION OF THE DRAWINGS

FIGS. 28(*a*)–(*b*) illustrate the relationship between the width of the ink supply port and a head with different nozzle diameters at a fixed timing of the second signal.

DETAILED DESCRIPTION OF THE PREFERRED EMBODIMENTS

The present invention will be described in detail with reference to the accompanying drawings.

Figure 1:
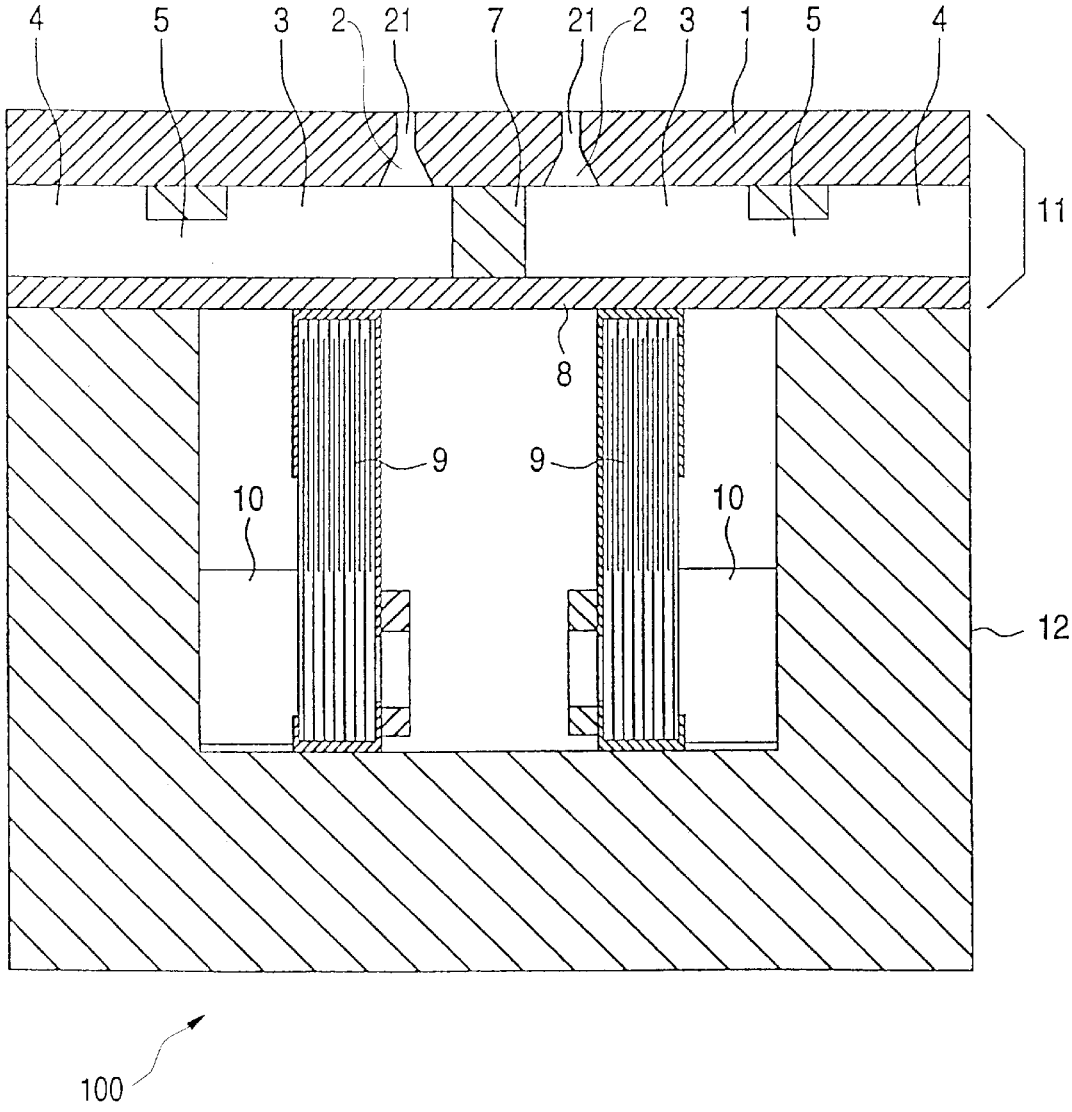
FIG. 1 illustrates an ink jet print head used in an ink jet printing device according to the present invention.

FIG. 1 illustrates an example of an ink jet print head used in the present invention. In FIG. 1, reference numeral 1 designates a nozzle plate; 7, a flow-path forming plate which is formed so that pressure generating chambers 3, communicate with common ink chamber 4 via ink supply port 5. Reference numeral 8 indicates an elastic plate. An ink flow path unit 11 is formed by tightly closing both sides of the flow-path forming plate 7 by the nozzle plate 1 and the elastic plate 8. The flow-path plate 7 may be formed integrally with the nozzle plate 1 and the elastic plate 8.

The ink flow path unit 11 includes the pressure generating chambers 3, the common ink chambers 4, and the ink supplying paths 5 connecting those chambers. The ink flow path unit 11 shoots forth ink droplets and sucks in ink when piezoelectric vibrators 9 extend and contract.

Each piezoelectric vibrator 9 is a longitudinal, or vertical, vibration mode vibrator having piezoelectric and conductive members, arranged in parallel and extended in the longitudinal direction, which are alternately layered. The piezoelectric vibrator 9 is a vibrator in a so-called vertical vibration mode in which it contracts in a direction perpendicular to the direction of the lamination of the electroconductive layer in a charged state, whereas it extends in a direction perpendicular to the direction of the lamination of the electroconductive layer when the charged state is released. In the discharged state, its inactive portion at the leading end where no electrode exists has been brought into contact with the elastic plate 8 in the area of the pressure generating chamber 3, the other end of the piezo-electric vibrator 9 is fixedly secured to a fixed board 10.

The ink-jet recording head thus constructed is driven to discharge ink drops as follows. When the piezo-electric vibrator 9 is charged with driving voltage, the elastic plate 8 kept in contact with the piezo-electric vibrator 9 is deformed and makes the pressure generating chamber 3 expand as the piezo-electric vibrator 9 contracts, so that ink is caused to flow from the common ink chamber 4 via the ink supply port 5 into the pressure generating chamber 3.

Subsequently, the piezo-electric vibrator 9 is discharged and extended to the original state so as to press down the elastic plate 8, whereby ink drops are discharged from the nozzle 2 through nozzle opening 21 as pressure is generated in the pressure generating chamber 3.

In the ink jet print head thus constructed, the Helmholtz resonance frequency FH of the pressure generating chamber 3 is expressed by:

$$FH=\tfrac{1}{2}\pi\times\sqrt{\{(Mn+Ms)/(Ci+Cv)\ (Mn\times Ms)\}}.$$

where Ci is the fluid compliance of the pressure generating chamber 3, caused by ink compression; Cv is the solid compliance of the members forming the pressure generating chamber 3, such as the elastic plate 8 and the nozzle plate 1; Mn is the innertance of the nozzle hole 2; and Ms is the innertance of the ink supplying path 5.

The Helmholtz resonance period TH is thus given by:

$$TH=2\pi\times\sqrt{((Mn+Ms)/(Ci+CV)\ (Mn+Ms))}.$$

The fluid compliance Ci is given by the relation $$Ci=V/\rho c^2$$

where V is the volume of the pressure generating chamber 3; ρ is the density of ink; and c is the sonic velocity in ink.

The solid compliance Cv of the pressure generating chamber 3 is equal to a static coefficient of strain of the pressure generating chamber 3 when a unit of pressure is applied to the pressure generating chamber 3.

In a specific example, the Helmholtz resonance frequency FH of a pressure generating chamber 3, the dimensions of which are 0.5 to 2 mm in length, 0.1 to 0.2 mm in width, and 0.05 to 0.3 mm in depth is 50 kHz to 200 kHz. The corresponding Helmholtz resonance period ranges from 5–20 $\mu$s.

Figure 2:
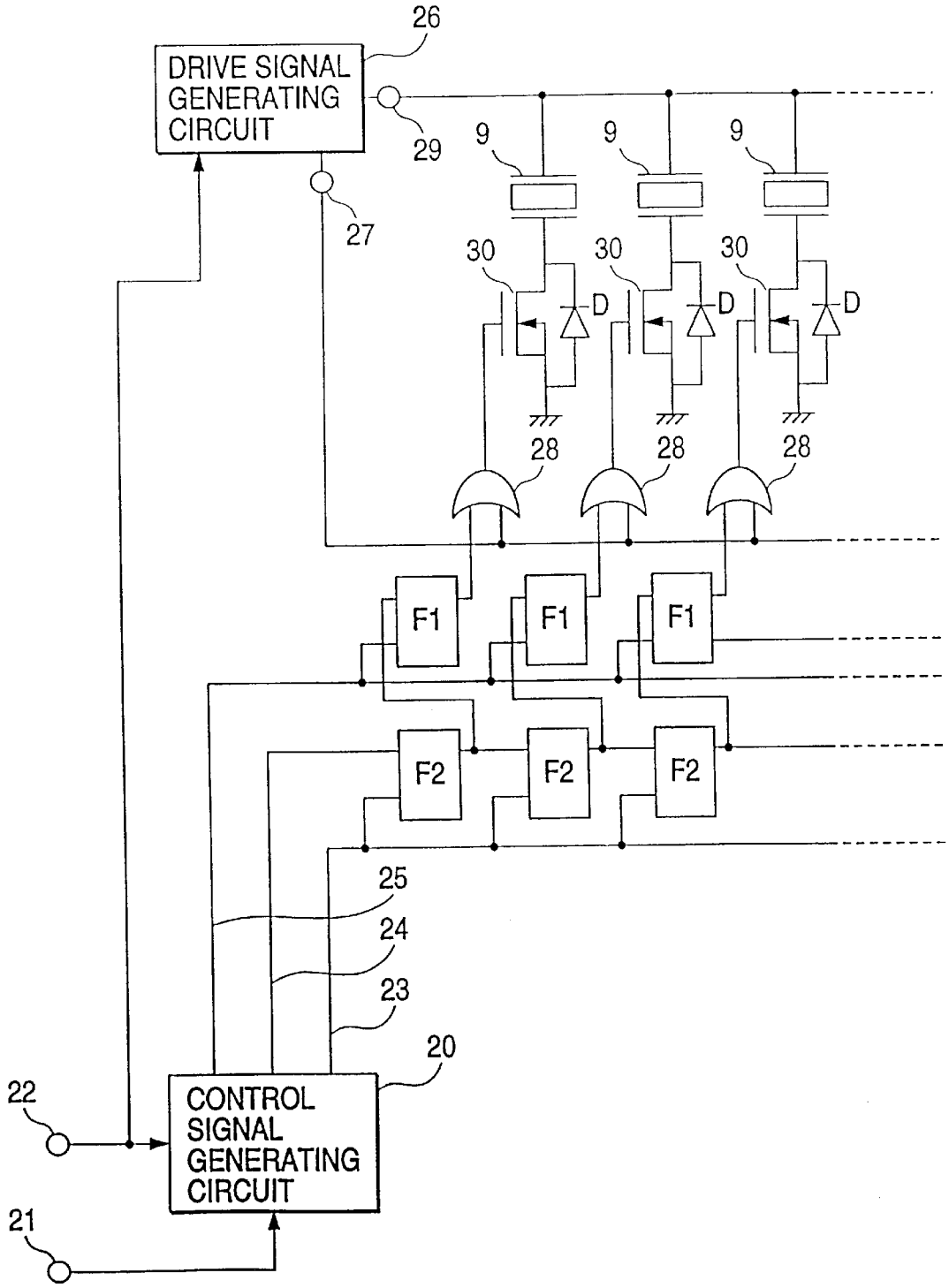
FIG. 2 illustrates an embodiment of an ink jet printing device according to the present invention.

FIG. 2 illustrates a drive circuit for driving the ink jet print head. In FIG. 2, a control signal generating circuit 20 includes input terminals 21 and 22 and output terminals 23, 24 and 25. The control signal generating circuit 20 receives at the input terminals 21 and 22 a print signal and a timing signal from an external device for generating print data, and outputs a shift clock signal, a print signal and a latch signal at the output terminals 23, 24 and 25.

A drive signal generating circuit 26 receives a timing signal from the external device by way of terminal 22, and generates drive signals for transmission to the piezoelectric vibrators 9.

A group of flip-flops F1 18 forms a latch circuit. Another group of flip-flops F2 19 forms a shift register. The flip-flops F2 produce print signals corresponding to the piezoelectric vibrators 9, respectively. The print signals are latched by the flip-flops F1, respectively. Then, those signals are selectively applied to switching transistors 30 through OR gates 28.

Figure 3:
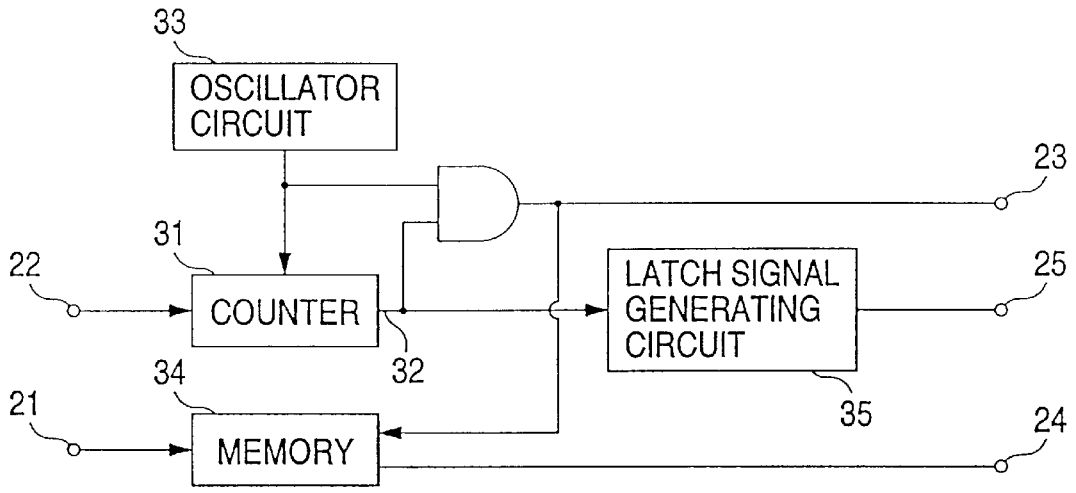
FIG. 3 is a block diagram of a control signal generating circuit in the ink jet printing device according to the present invention.

FIG. 3 illustrates the control signal generating circuit 20. In FIG. 3, a counter 31 is initialized at the leading edge of a timing signal (FIG. 5(*a*)) received at the terminal 22, counts a clock signal received from an oscillator circuit 33 until its count reaches the number of piezoelectric vibrators 9 that are connected to the output terminal 29 of the drive signal generating circuit 26, outputs a carry signal in LOW level, and stops the counting operation. The carry signal from the counter 31 is applied to an AND gate 17 which in turn ANDs the carry signal and a clock signal coming from the oscillator circuit 33, and outputs the result as a shift clock signal to the terminal 23.

A memory 34 receives print data from terminal 21 and stores it therein. The print data consists of the number of bits that is equal to the number of piezoelectric vibrators 9. In addition, the memory 34 serially outputs the print data bit by bit to the terminal 24 in synchronism with a signal from the AND gate.

Figure 5:
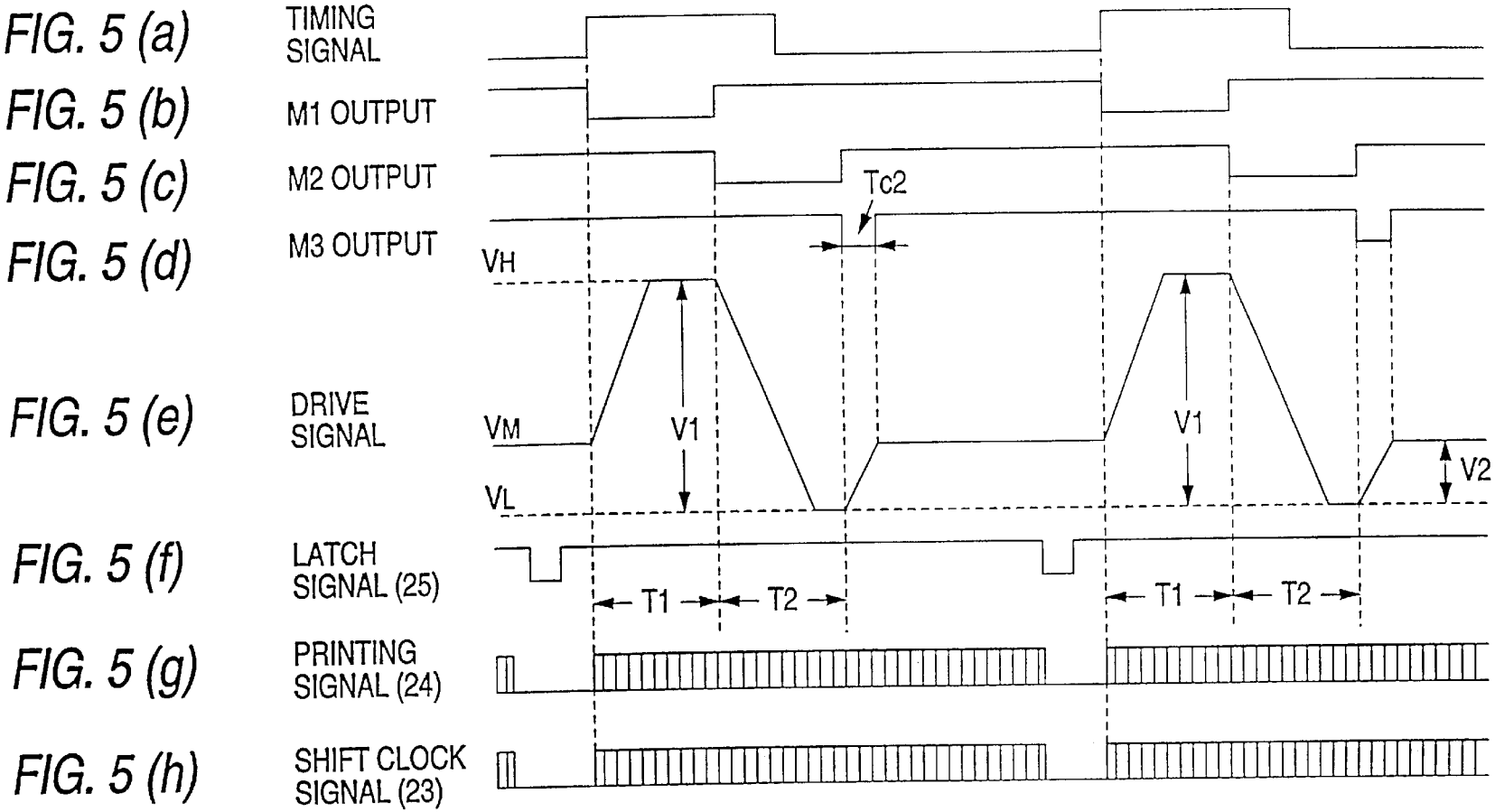
FIGS. 5(*a*) to 5(*h*) are waveforms showing an operation of the ink jet printing device according to the first embodiment.
Figure 6:
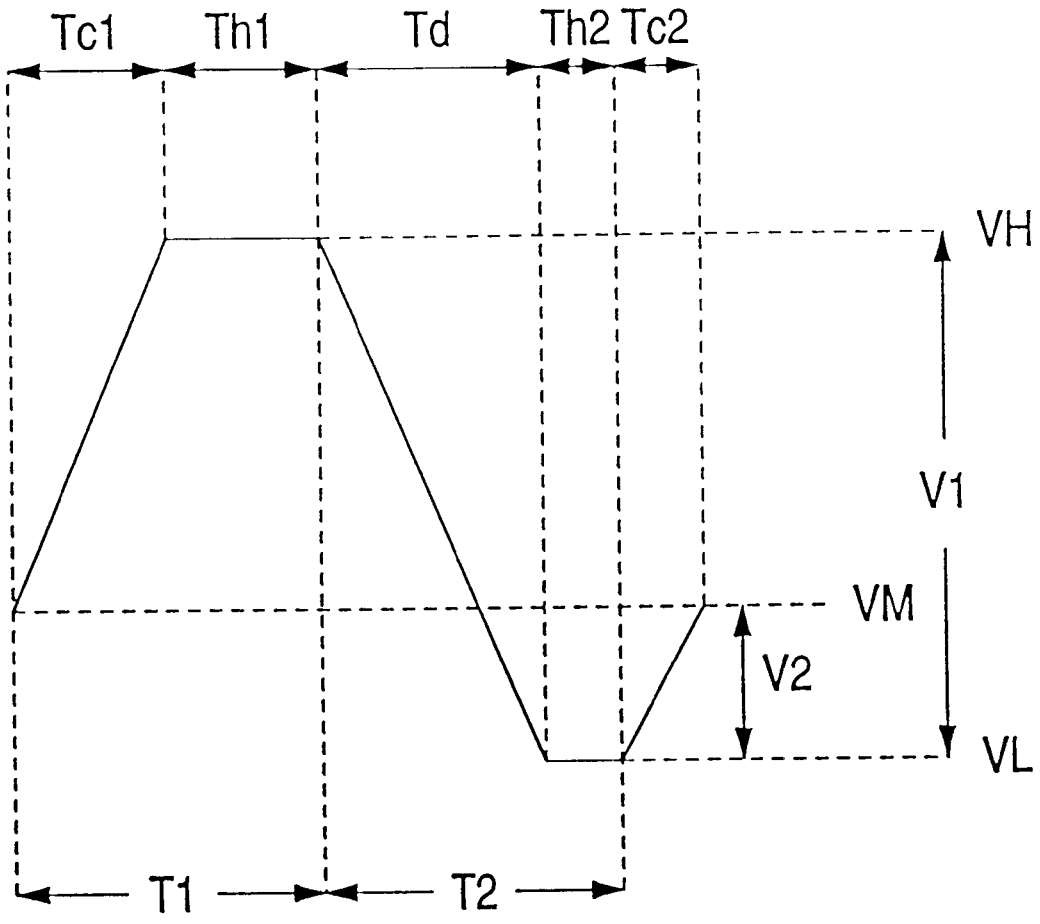
FIG. 6 is a diagram showing the parameters defining a drive signal.

Print signals (FIG. 5(*g*)), serially output from terminal 24, become select signals for the switching transistors 30 in the next printing cycle. The select signals are latched in the flip-flops F1 18 of the shift register by a shift clock signal (FIG. 5(*h*)) output from terminal 23. A latch signal is output from a latch signal generating circuit 35 at the trailing edge of the carry signal. The latch signal is output when a drive signal to be output is kept at a medium potential VM.

Figure 4:
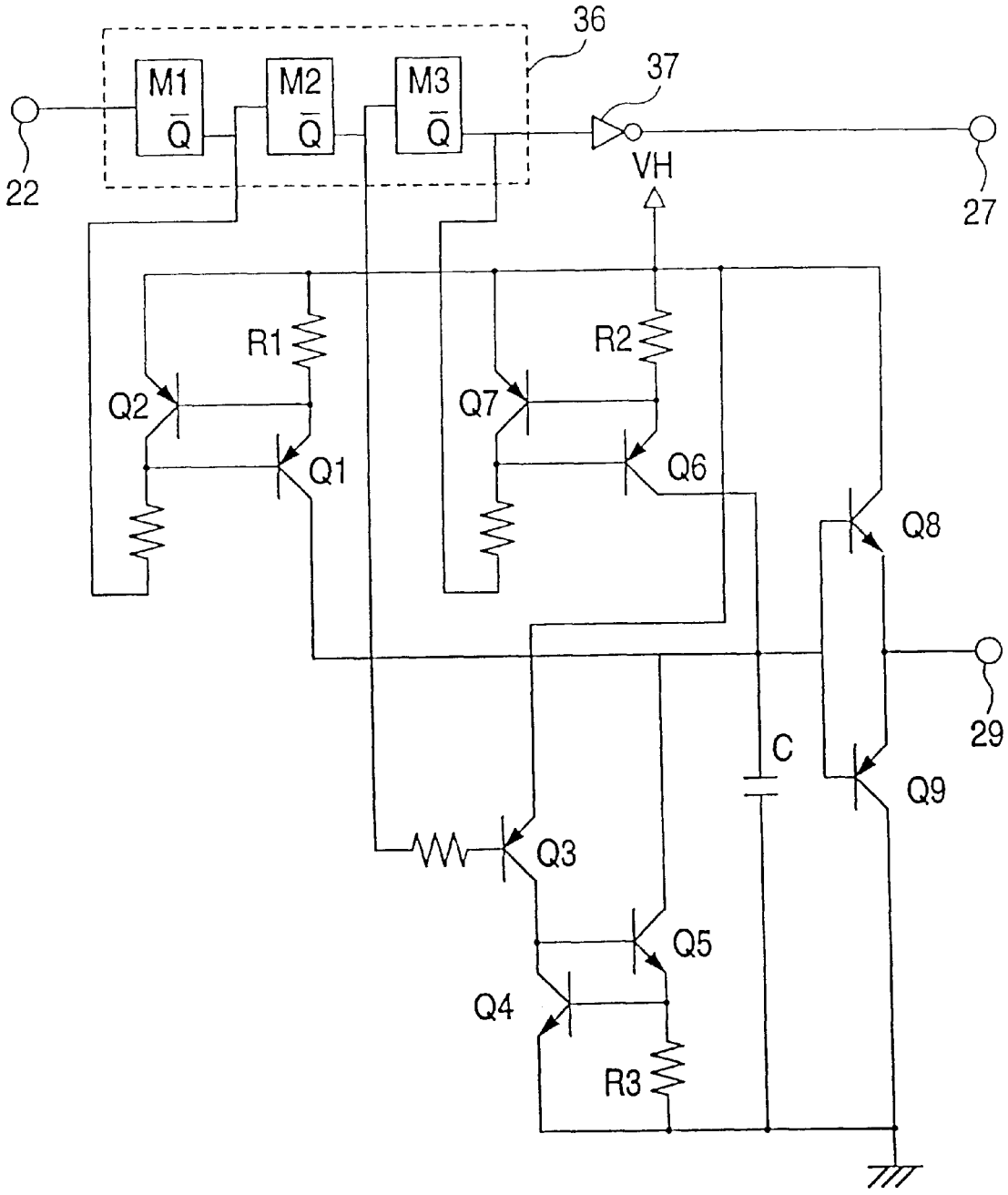
FIG. 4 illustrates an embodiment of a drive signal generating circuit in the ink jet printing device according to the present invention.

FIG. 4 illustrates the drive signal generating circuit 26. A timing control circuit 36 includes three one-shot multivibrators M1, M2 and M3. Pulse widths PW1, PW2 and PW3 (FIGS. 5(*b*)–5(*d*)) are set up in the one-shot multivibrators, respectively. The pulse widths are used to determine the sum T1 of a first charging time (Tc1) and a first hold time (Th1) (T1=Tc1+Th1), the sum T2 of a discharging time (Td) and a second hold time (Th2) (T2=Td +Th2), and a second charging time(tc2).

The drive circuit 26 further includes a transistor Q2 for a charging operation, a transistor Q3 for a discharging operation, and a transistor Q6 for a second charging operation. The transistors are turned on and off at the leading edges and the trailing edges of the output pulses of the one-shot multivibrators M1, M2 and M3.

When a timing signal is input from the external device to the terminal 22, the one-shot multivibrator M1 of the timing control circuit 36 produces a pulse signal (FIG. 5(*b*)) of the pulse width PW1 (Tc1+Th1), preset in the one-shot multivibrator M1. In response to the pulse signal, a transistor Q1 is turned on, so that a capacitor C, that was charged under the medium potential VM in an initial state, is charged by a constant current Ic1, determined by the transistor Q2 and a resistor R1. During the charging operation, the voltage across the capacitor C reaches a voltage VH of a power source. At this time, the charging operation automatically stops, and subsequently the capacitor is kept at this voltage until it is discharged.

When the time (Tc1+Th1)=T1 corresponding to the pulse width PW1 of the one-shot multivibrator M1 elapses, the operation state of the one-shot multivibrator M1 is inverted. At this time, the transistor Q1 is turned off. The one-shot multivibrator M2 produces a pulse signal having pulse width PW2 (FIG. 5(*b*)), which turns on the transistor Q3 to discharge the capacitor C. The capacitor is discharged with a flow of a constant current Id determined by a transistor Q4 and a resistor R3, and the discharging operation is continued until the voltage across the capacitor decreases to be substantially equal to the voltage VL.

When the time (Td+Th2)=T2 corresponding to the pulse width PW2 of the one-shot multivibrator M2 elapses, the operation state of the one-shot multivibrator M2 is inverted. At this time, the one-shot multivibrator M3 produces a pulse signal having pulse width PW3 (FIG. 5(*d*)), which turns on the transistor Q6. Then, the capacitor C is charged again by a constant current Ic2. The voltage across the capacitor C is increased up to the medium potential VM, determined by a time (Tc2) corresponding to the pulse width PW3 of the one-shot multivibrator M3. When the capacitor voltage reaches the medium potential VM, the charging operation terminates.

Through the charging and discharging operations, the drive signal varies, as shown in FIG. 5(*e*), such that it rises from the medium potential VM to the voltage VH at a fixed gradient, the voltage VH is maintained for a fixed period Th1 of time, and falls to the voltage VL at a fixed gradient, the voltage VL is maintained for a fixed period Th2 of time, and rises to the medium potential VM.

The charging current Ic1, the discharging current Id, the charging current Ic2, the charging time Tc1, the discharging time Td, and the charging time Tc2 are given by:

Ic1=Vbe2/Rr1;

Id=Vbe4/Rr3;

Ic2=Vbe7/Rr2;

Tc1=CO×(VM—VM) /Ic1;

Td=CO×(VM–VL)/Id;

Tc2=CO×(VM–VL) /Ic2;

where CO is the capacitance of the capacitor C in the drive signal generating circuit 26;

Rr1 is the resistance of the resistor R1;

Rr2 is the resistance of the resistor R2;

Rr3 is the resistance of the resistor R3;

Vbe2 is the voltage between the base and the emitter of the transistor Q2;

Vbe4 is the voltage between the base and the emitter of the transistor Q4;

Vbe7 is the voltage between the base and the emitter of the transistor Q7.

The longitudinal vibration mode piezoelectric vibrator 9 is used as the actuator for expanding/compressing the pressure generating chamber 3. In the print head of the type in which the Helmholtz resonance frequency of the pressure generating chamber 3 is increased for the purpose of high speed driving, a duration of the residual vibration of the piezoelectric vibrator 9, which follows the shooting of the ink droplet, is longer than the period TH of the Helmholtz resonance frequency, as described above. Accordingly, the meniscus is adversely affected by the residual vibration of the piezoelectric vibrator 9.

To suppress the residual vibration of the piezoelectric vibrator 9, in the present embodiment, the discharge time constant Td when the extension of the piezoelectric vibrator 9 is made to shoot forth the ink droplet, and the charge time constant Tc2 when the pressure generating chamber 3 is minutely expanded, are each selected to be equal to the period of the natural vibration of the piezoelectric vibrator 9. Further, the Helmholtz resonance period TH, the charging time constant Tc1, and the discharging time constant Td are selected so as to satisfy the following relations:

O. 5TH <Tcl <2TH, preferably Tcl≈

Td≈Ta, preferably Td<TH, and

Tc2≈Ta, preferably Tc2<TH.

Further, V2/V1=R2/1 is selected to be within a range from 0.1 to 0.5. In the ratio, V1 is a potential difference between a discharge voltage, i.e., a constant voltage set up after the charging operation ends, and a potential when the discharging operation ends, and V2 is a potential difference between a potential when the discharging operation ends and the medium potential VM.

The operation of the ink jet printing device will be described.

As described above, the control signal generating circuit 20 transfers select signals for selecting the switching transistors 30 to the flip-flops F1 18 in the preceding printing cycle, and the flip-flops F1 latch the received select signals during a period when all of the piezoelectric vibrators 9 are being charged to the medium potential VM. Thereafter, a timing signal is applied, the drive signal shown in FIG. 5(*e*) increases from the medium potential VM to the voltage VH, to charge the piezoelectric vibrator. During charging, the piezoelectric vibrator 9 contracts at a fixed rate to expand the pressure generating chamber 3.

When the pressure generating chamber 3 expands, ink flows from the common ink chamber 4 to the pressure generating chamber 3 by way of the ink supplying path 5, while at the same time the meniscus in the nozzle hole 2 is pulled to the pressure generating chamber 3. The drive signal increases to the voltage VH and is kept at the voltage VH for a preset period of time Th1, and then decreases to the potential VL. When the drive signal decreases to the potential VL, each of the piezoelectric vibrators 9, which were charged and have been kept at the potential VH, is discharged through the diode D associated therewith, so that the piezoelectric vibrator 9 extends to compress the pressure generating chamber 3 associated therewith. The pressure generating chamber 3 is compressed and ink contained therein is shot forth in the form of an ink droplet, through the nozzle hole 2. In the alternative, the apparatus may be constructed such that the piezoelectric vibrators are discharged to expand the pressure generating chambers and are subsequently charged to compress the chambers and expel the ink. In either case, after ink is expelled from the pressure generating chamber, the meniscus in the nozzle hole 2 starts to vibrate.

In the present embodiment, when the vibration of the meniscus is pulled to the pressure generating chamber 3 in the extreme, and reverses its course to the nozzle hole 2, the drive signal increases again from the potential VL to the medium potential VM. As a result, the piezoelectric vibrator 9 is charged again, and the pressure generating chamber 3 is minutely expanded. By the minute expansion of the pressure generating chamber 3, the meniscus that reversed its course to the nozzle hole is once again pulled to the pressure generating chamber 3. The meniscus loses its kinetic energy and its vibration is rapidly attenuated.

Thus, to suppress the vibration of the meniscus generated after an ink droplet is jet out, it is desirable to apply a force to the ink in the pressure generating chamber 3 in a direction which is opposite to the moving direction of the meniscus. Accordingly, it is preferable to set the timing of the minute expansion of the pressure generating chamber 3, caused by a third signal ((3) in FIG. 7), at a time point (t2 in FIG. 7) where the minute vibration of the meniscus generated after ink is shot forth starts to move to the nozzle hole.

Figure 7:
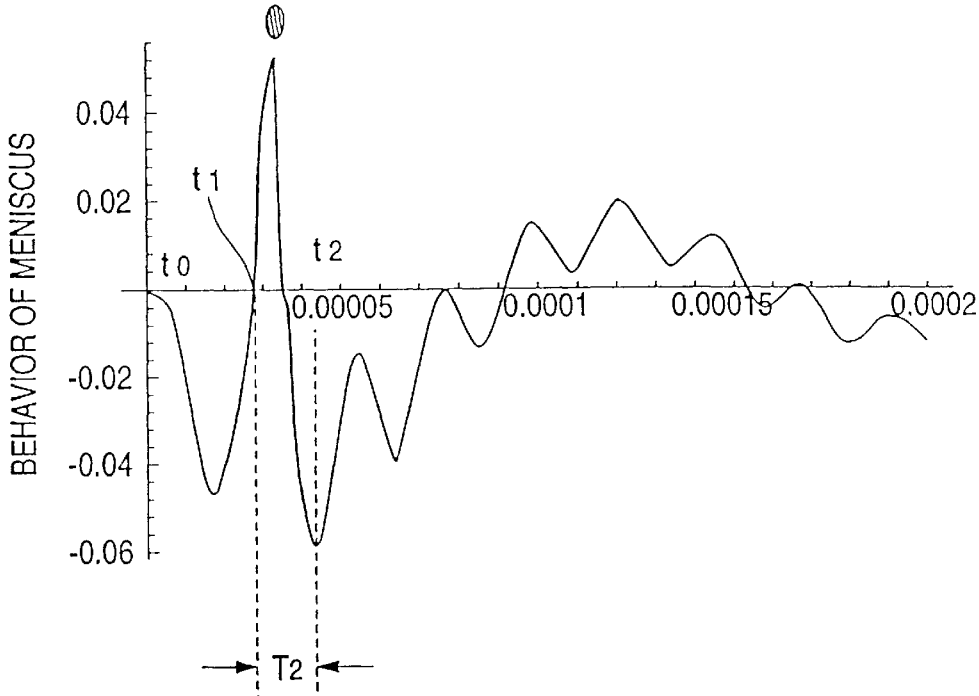
FIGS. 7(*a*) and 7(*b*) illustrate the behavior of a meniscus in connection with a drive signal.
Figure 7:
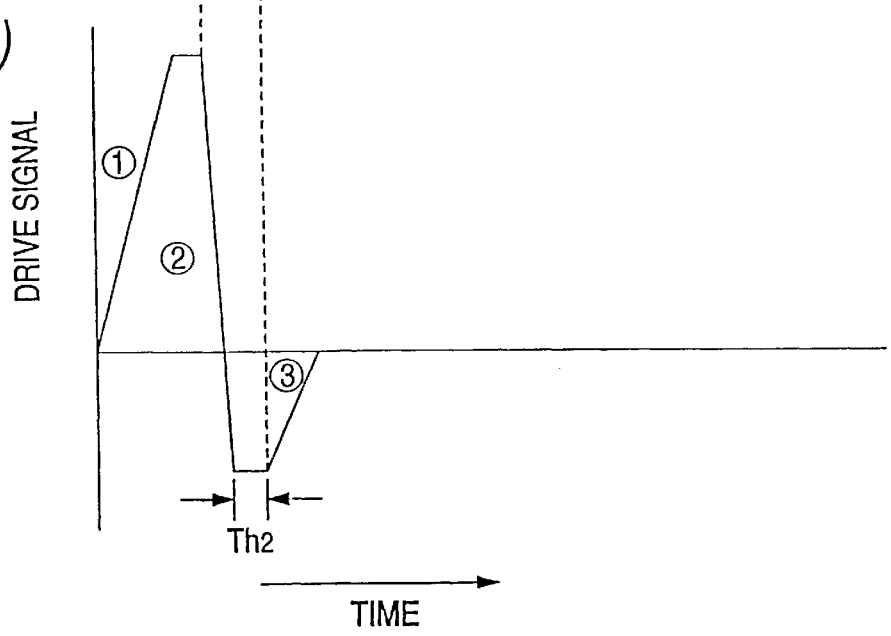

Ink in the pressure generating chamber 3 starts to vibrate when a second signal ((2) in FIG. 7) is applied to the piezoelectric vibrator 9 and the pressure generating chamber 3 is compressed. Therefore, the timing of applying the third signal ((3) in FIG. 7) is preferably set such that Td+TH2≈TH×n (n is an integer equal to or larger than 1). The suppression of the vibration in the earliest possible stage, e.g., in a stage where the meniscus lies at the back of the pressure generating chamber 3, will be effective in preventing generation of ink mist by the vibration of the meniscus and in reducing a time up to the next shooting of ink. Therefore, the timing of applying the third signal (3) is preferably set at a time point where n=1, the smallest value.

A relative magnitude of the minute expansion of the pressure generating chamber 3, a ratio R2/1 of the charging voltage V2 by the third signal (3) and the discharging voltage V1 to shoot forth the ink droplet, is preferably 0.1 to 0.5, more preferably 0.2 to 0.4.

Figure 8:
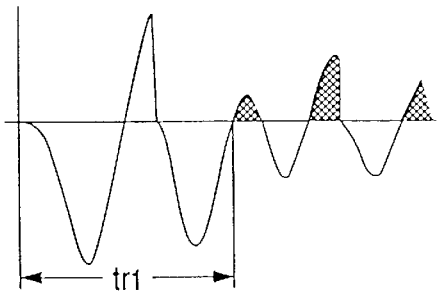
FIGS. 8(*a*) to 8(*f*) illustrate the behavior of a meniscus when a ratio of a second drive signal to the full drive voltage is varied.
Figure 8:
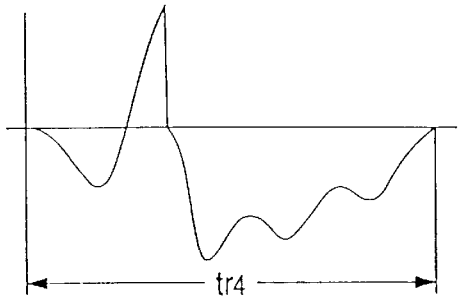
Figure 8:
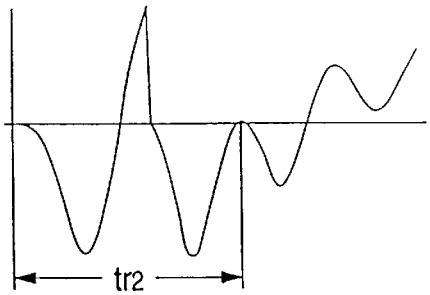
Figure 8:
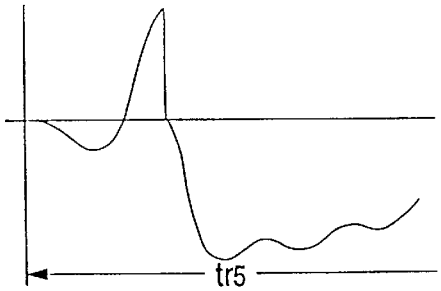
Figure 8:
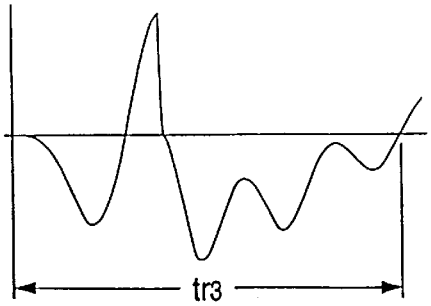
Figure 8:
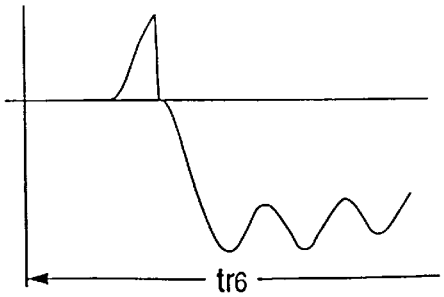

When the third signal (3) is not applied, a time tr1, shown in FIG. 8(*a*), of free vibration of the meniscus, which is generated after the ink droplet is shot forth, to return to a position suitable for jetting out the next ink droplet, (a position near to the opening of the nozzle hole) is very short. In this case, the meniscus greatly projects from the opening of the nozzle hole (as indicated by cross hatching in FIG. 8(*a*)). Accordingly, ink mist generated by the kinetic energy of the meniscus tends to occur.

When the voltage V2 of the third signal (3) is varied to be equal to the discharging voltage V1, the meniscus is greatly pulled to the pressure generating chamber 3 as shown in FIG. 8(*f*). Accordingly, ink mist generation is prevented. In this case, however, a time tr6 for the meniscus vibration to reach the position for the next ink droplet is considerably long. This fact necessitates the lowering of the drive frequency.

When the ratio R2/1 is set at approximately 0.1 on the basis of the above results, the meniscus vibrating in free vibration mode is pulled to the pressure generating chamber as shown in FIG. 8(*b*). Accordingly, the kinetic energy of the meniscus is reduced, the generation of ink mist is prevented, and a time tr2 for the meniscus to return to the position for the next ink droplet is reduced.

When the ratio R2/1 is stepwise increased to 0.3, 0.5, and 0.7, the vibration of the meniscus is rapidly reduced as shown in FIGS. 8(*c*), 8(*d*), and 8(*e*). In this case, however, the meniscus is greatly pulled to the pressure generating chamber. Accordingly, times tr3, tr4 and tr5 for the meniscus to return to the position for the next ink droplet are increased.

From the foregoing, it is seen that if the voltage ratio R2/1 of the drive signal is set in the range from 0.1 to 0.5, preferably 0.2 to 0.4, a high frequency response of 10 kHz or higher is obtained. In addition, ink mist generation can be prevented and the printing speed can be improved.

As already referred to, the meniscus in the nozzle hole 2 is pulled to the pressure generating chamber at a speed proportional to an expanding rate of the pressure generating chamber 3, and reverses its course at the position where it is pulled in the extreme and returns to the nozzle hole 2 while vibrating. This phenomenon is shown in FIGS. 10(*a*) and 10(*b*).

Figure 10:
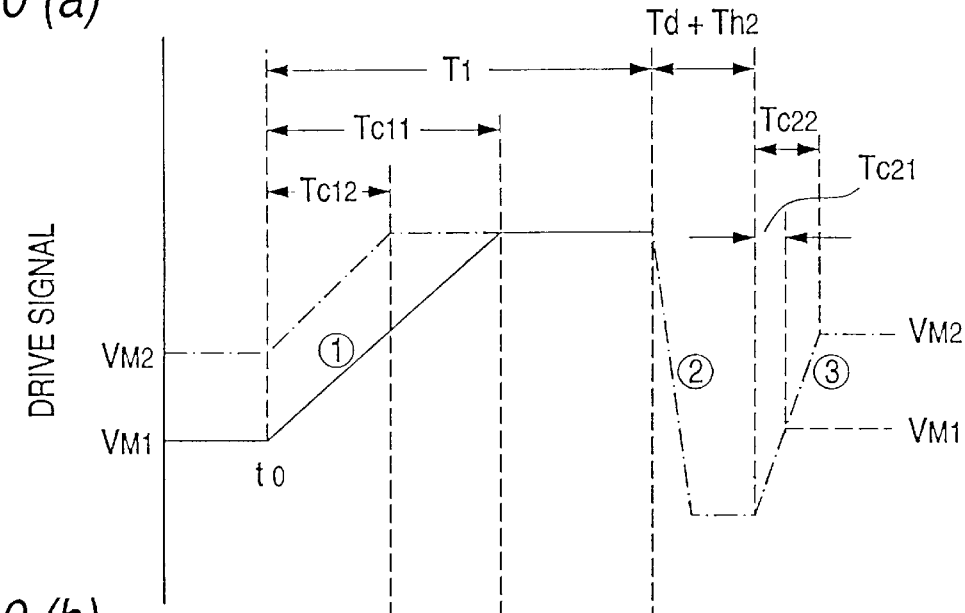
FIGS. 10(*a*) and 10(*b*) illustrate the behavior of a meniscus from an instant that an expansion of the pressure generating chamber starts until an ink droplet is shot forth.
Figure 10:
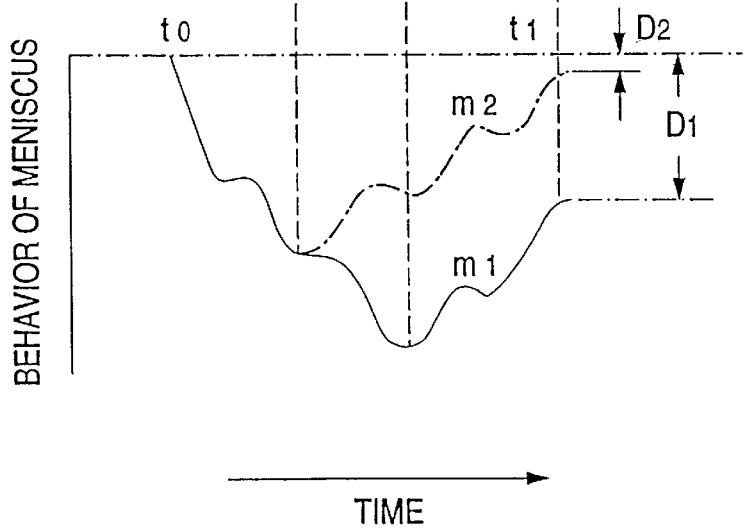

In FIGS. 10(*a*) and 10(*b*), there is graphically illustrated a relationship of a drive signal to expand the pressure generating chamber 3 by contracting the piezoelectric vibrator 9 and a quantity of the movement of 25 the meniscus pulled at that time. In FIGS. 10(*a*) and 10(*b*) , a solid line indicates a motion of the meniscus when the voltage of the drive signal is increased from a medium potential VM1 to the voltage VH, and a one dot chain line indicates a motion of the meniscus when the drive signal voltage is increased from a voltage VM2 higher than the voltage VM1, to the voltage VH.

As indicated by m1 and m2 in FIG. 10(*b*), the amount of the movement of the pulled meniscus after a preset time T1 elapses from the start of the expansion of the pressure generating chamber 3 is proportional to the amount of an expansion of the pressure generating chamber 3. Therefore, if the pressure generating chamber 3 is compressed at a fixed timing, the meniscusci are located at positions indicated by distances D1 and D2 at a time point where an ink droplet is shot forth.

When the voltage of the drive signal is increased from the medium potential VM1 to the voltage VH, at the time of shooting forth the ink droplet, the meniscus lies at a position located apart from the nozzle hole 2 by long distance D1. Accordingly, an amount of ink of the droplet is small, so that a small dot is formed on a print sheet.

When the voltage of the drive signal is increased from the medium potential VM2 to the voltage VH, at the time of shooting forth the ink droplet, the meniscus lies at a position located apart from the nozzle hole 2 by short distance D2. Accordingly, an amount of ink of the droplet is large, so that a large dot is formed on a print sheet. From this fact, it is seen that the dot size can be adjusted by varying the medium potential of the drive signal and accordingly the amount of the ink of the droplet.

Figure 9:
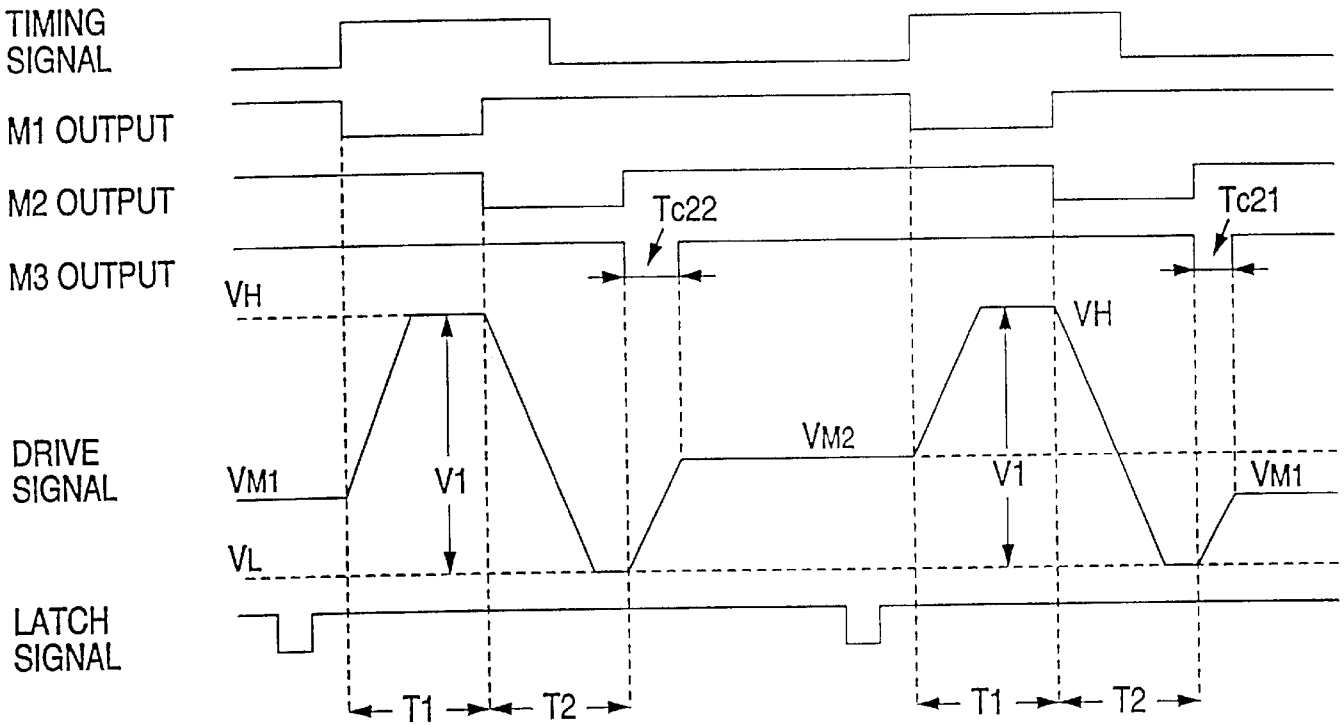
FIGS. 9(*a*) to 9(*f*) show waveforms for explaining a second embodiment of the present invention.

A second embodiment of the present invention, designed so as to be able to adjust the size of dots to be formed on a recording medium by actively utilizing the above phenomenon, is shown in FIGS. 9(*a*)–9(*f*). This embodiment uses a drive means having substantially the same functions as those already mentioned referring to FIGS. 2 to 4.

However, the one-shot multivibrator M3 in the timing control circuit 36 has additionally an adjusting function to variably set the time constant thereof by an external signal such that a host device can adjust the pulse width of the output signal of the multivibrator.

In the present embodiment, when receiving a timing signal, the expansion of the pressure generating chamber 3 starts. After a time period T1 elapses from the start of the chamber expansion, the pressure generating chamber 3 is compressed to shoot forth an ink droplet. A sequence of the above operations of the embodiment is as described above. At a time point where the vibration of the meniscus, generated with the shooting of the ink droplet, reverses its course to the nozzle hole, the one-shot multivibrator M3 operates to increase the voltage of the drive signal from the voltage VL to the medium potential and to minutely expand the pressure generating chamber 3.

At this time, the pulse width of the output signal of the one-shot multivibrator M3 is adjusted to determine the size of a dot to be printed in the next printing cycle. The voltage of the medium potential VM is proportional to the pulse width of the output signal of the one-shot multivibrator M3. Accordingly, by controlling the pulse width of the output signal of the one-shot multivibrator M3 by a signal from the host device, the medium potential in the producing of the next ink droplet, i.e., a charge start voltage of the piezoelectric vibrator 9, is adjusted to voltages VH1 and VH2, and consequently the size of a dot to be printed on a recording medium can be changed as desired.

Figure 11:
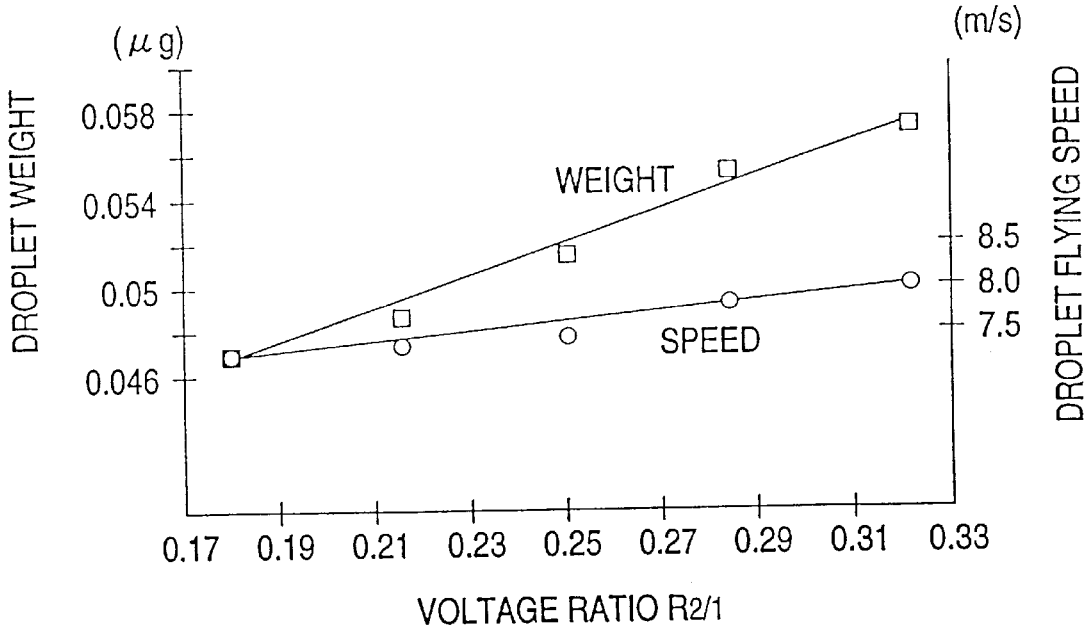
FIG. 11 illustrates the variations of a flying speed and an amount of an ink droplet to a ratio of the discharging voltage to a minimum charging voltage.

FIG. 11 graphically shows variations of the weight and the flying speed of an ink droplet when the medium potential VM is varied, specifically a ratio R2/1 of the medium potential VM to the voltage V1 to shoot forth an ink droplet is varied in the range from 0.18 to 0.33. As seen from the graph, the variation of the flying speed of the ink droplet is extremely small; that is, the flying speed increased approximately 1.06 times, in the range from 7.5 m/s to 8.0 m/s. In other words, the flying speed takes a substantially fixed value irrespective of the medium potential VM. However, the variation of the amount of ink of the droplet is large. The amount of ink increased 1.2 times, in the range from 0.046 to 0.056.

The foregoing demonstrates that the size of the dot to be printed on the print paper can be controlled as desired without varying the landing position of the ink droplet and generating ink mist, when the ratio R2/1 is adjusted by varying the pulse width PW3 of the output signal of the one-shot multivibrator M3.

In the above described embodiment, the ink weight is changed to intentionally adjust the dot size by changing the medium potential. The change of the medium potential is used for stably expelling the ink weight regardless of the environment temperature.

The ink viscosity characteristic is changed in accordance with the environment temperature. If the environment temperature is in a high temperature which is higher than a normal temperature (approximately 25° C.), the ink viscosity in high temperature is lower than the ink viscosity in the normal temperature, whereas if the environment temperature is in a low temperature which is lower than the normal temperature, the ink viscosity in the lower temperature is higher than the viscosity in normal temperature. According to the change of the ink viscosity depending upon the change of environment temperature, when the temperature becomes high, the expelled ink weight is increased, whereas when the temperature becomes low, the expelled ink weight is decreased.

Under the high temperature, the medium potential is shifted to a lower side from the reference medium potential VM in the normal temperature. Under the low temperature, the medium potential is shifted to a higher side from the reference medium potential VM in the normal temperature. As a result, it is possible to stably expel the ink weight regardless of the environment temperature.

Namely, under the high temperature, the medium potential is adjusted to decrease the ink weight as compared with the normal temperature so that this adjustment is cancelled out the increase of the ink weight at the high temperature. As a result, there is expelled the ink weight as the same as the ink weight in the normal condition.

A third embodiment of the invention which actively utilizes the timing control circuit 36 so as to keep the print quality satisfactory irrespective of the specifications of the print head and variations of ambient temperature, will be described. As described above, when an ink droplet is jet out, the meniscus in the nozzle hole 2 vibrates as shown in FIG. 7(*a*). The frequency of the vibration of the meniscus is determined by the frequency FH of the Helmholtz resonance. The frequency FH depends on the tolerances in manufacturing the print heads and the physical properties of ink.

For this reason, even if the print heads are manufactured according to the same specifications, the Helmholtz resonance frequency of the print heads is frequently different for every lot. This problem can be solved by conforming the pulse width PW2 of the output signal of the timing adjusting means, e.g., the one-shot multivibrator M2 in the present embodiment, in the control unit assembled into the printing device, to the Helmholtz resonance frequency of each print head.

Figure 12:
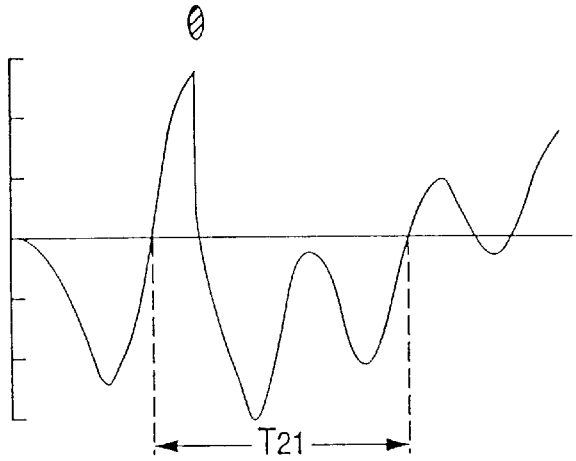
FIGS. 12(*a*) to 12(*c*) show a Helmholtz resonance frequency and the returning times of the meniscus after jetting out an ink droplet.
Figure 12:
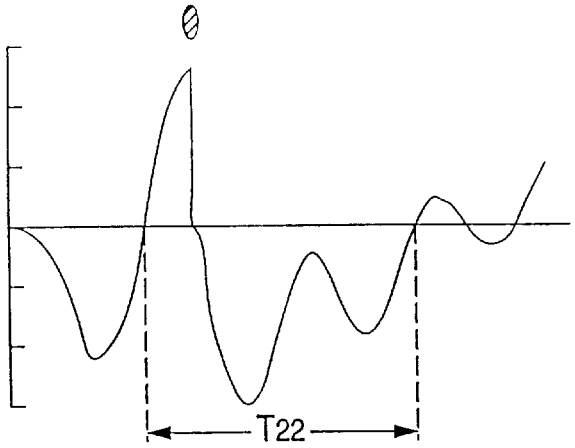
Figure 12:
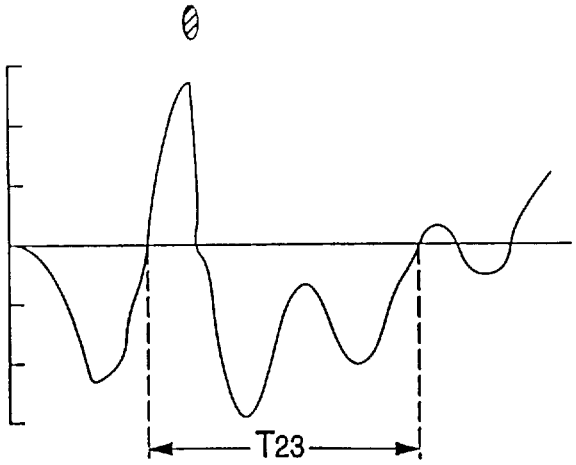

Specifically, when the Helmholtz resonance frequency varies, times T21, T22 and T23, each from a discharge start point t1 until the meniscus returns to the nozzle hole 2, are minutely different as shown in FIGS. 12(*a*), 12(*b*) and 12(*c*). If the time is finely adjusted in each print head so that when the vibration of the meniscus reaches the optimum position, the operation state of the one-shot multivibrator M2 is inverted, then the pressure generating chamber 3 is minutely expanded in the next stage. Accordingly, the kinetic energy of ink in the pressure generating chamber 3 is properly reduced, to thereby prevent the generation of ink mist.

In other words, the pressure generating chamber can be minutely expanded always at the optimum timing in such a simple manner that a time point of applying the third signal is properly adjusted for every print head by the pulse width PW2 of the output signal of the one-shot multivibrator M2. Even if the print heads are not uniform in the Helmholtz resonance frequency FH, the print heads may be driven at the same drive frequency without deteriorating the print quality.

Dimensions and elastic modulus of the print head, and the physical properties of ink vary depending on ambient temperature. Accordingly, the frequency FH of the Helmholtz resonance is also dependent largely on ambient temperature.

Figure 13:
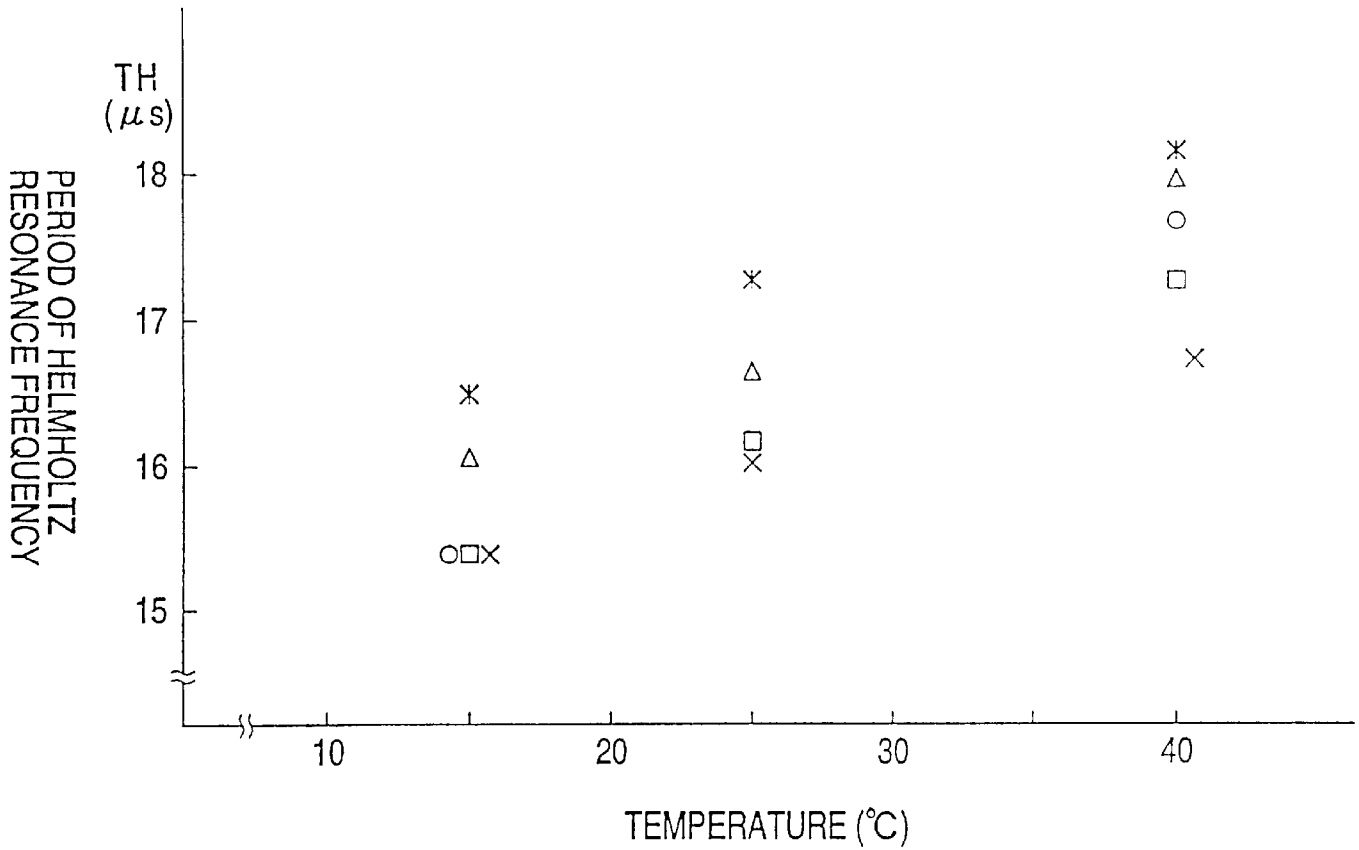
FIG. 13 illustrates the relationship between ambient temperature and the period of a Helmholtz resonance frequency.

Samples of print heads were picked up from a number of manufactured print heads, and the temperature dependency of the period TH of the Helmholtz resonance frequency of each sample was investigated. As shown in FIG. 13, the periods of the Helmholtz resonance frequencies (these period values are indicated with marks *, Δ, ○, □ and X) were varied with temperature. No difference was confirmed in the rate of change of the frequency FH of the Helmholtz resonance among the print heads. Further, variations of the rates of change of the frequencies FH of the print heads with respect to temperature were similar.

Figure 14:
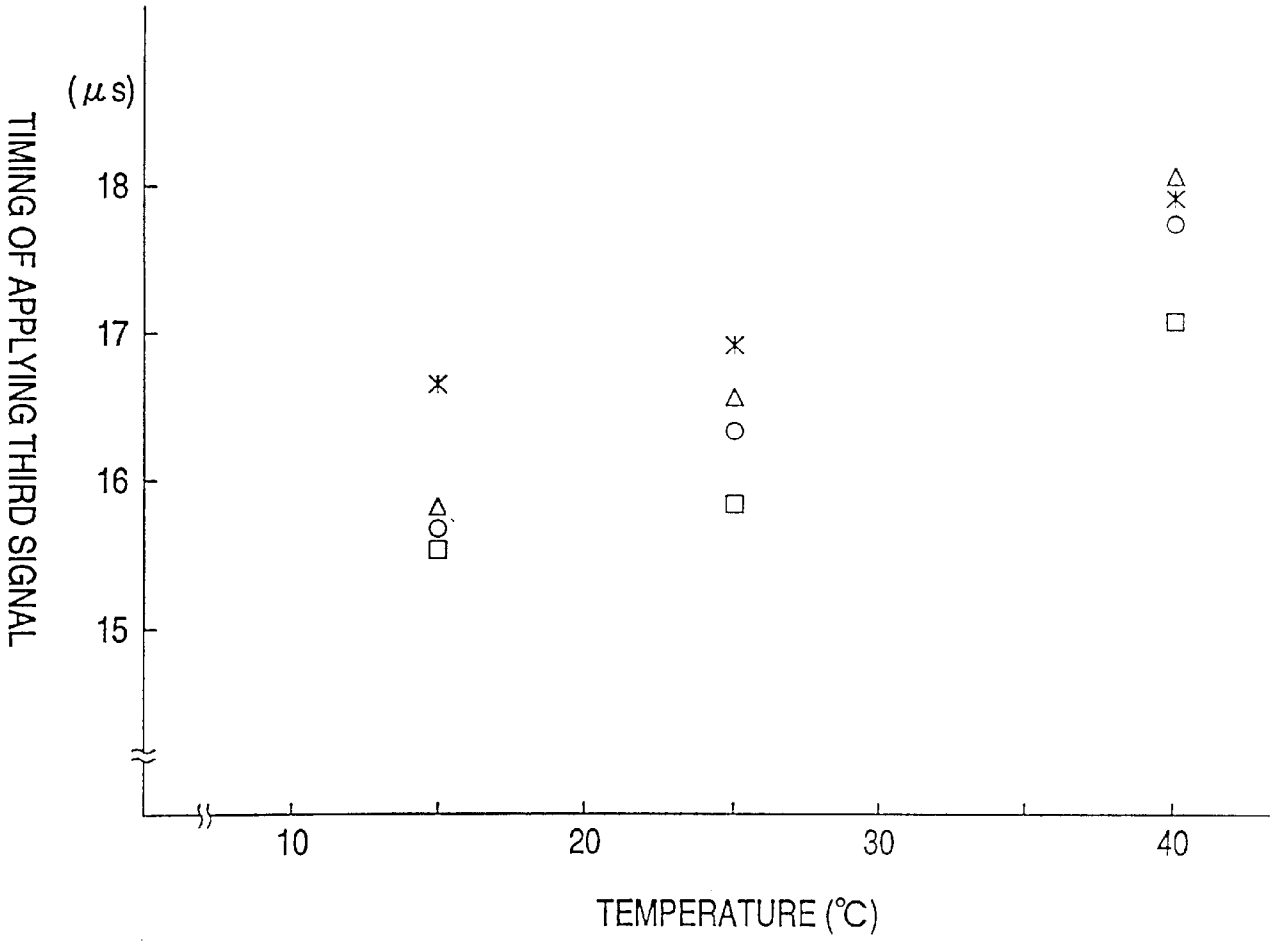
FIG. 14 illustrates the relationship between ambient temperature and the timing of applying a third signal.

As shown in FIG. 14, the time T2 from an instant that the discharging operation starts to jet an ink droplet until the third signal (signal (3) in FIG. 7) is applied is adjusted in accordance with ambient temperature. By adjusting this time, the pressure generating chamber 3 may be expanded again at a time point where the kinetic energy of the meniscus going to the nozzle hole may be effectively attenuated. Accordingly, the generation of ink mist can reliably be prevented irrespective of ambient temperature.

Figure 15:
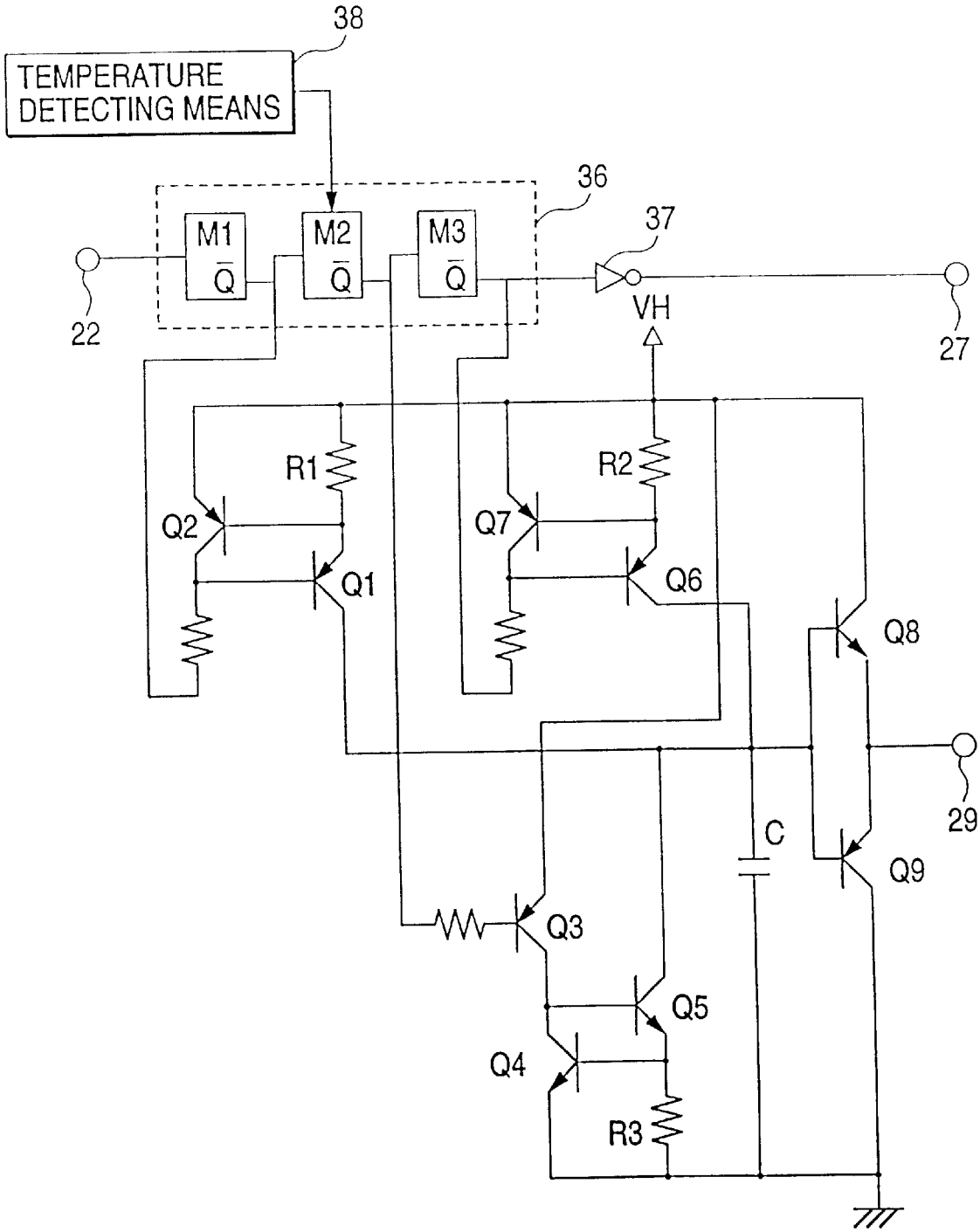
FIG. 15 illustrates a third embodiment of the present invention.

FIG. 15 shows a third embodiment of the invention which is capable of adjusting the time of applying the third signal in accordance with ambient temperature. In the embodiment, a signal output from a temperature detecting means 38 is input to the one-shot multivibrator M2 in the timing control circuit 36, to thereby control the pulse width PW2 of the pulse signal output from the one-shot multi vibrator M2.

The embodiment is capable of adjusting the time of starting a minute expansion of the pressure generating chamber 3 in accordance with ambient temperature, in response to a signal output from the temperature detecting means 38. Accordingly, the kinetic energy of the meniscus is attenuated with certainty irrespective of a variation of ambient temperature, and hence a stable jetting of the ink droplet is attained.

No print signal is present and hence the piezoelectric vibrators 9 are connected to the switching transistors 30 being in a nonconductive state, and the vibrators start their discharge when the voltage of the drive signal drops below the medium potential VM during the course of the voltage decreasing of the drive signal from the voltage VH to the potential VL. Then, the pressure generating chamber 3 is minutely compressed.

An output signal of the one-shot multivibrator M3, which is inverted in signal level by an invertor 37, makes all of the switching transistors 30 active through the OR gates 28. As a consequence, the piezoelectric vibrators 9, not involved in the printing operation, minutely expand and compress the pressure generating chambers 3 to such an extent as not to jet ink droplets. The minute vibration causes an agitation of the ink in a region near the nozzle hole and the ink in the pressure generating chamber, which minimizes the increase of viscosity of the ink in the nozzle hole 2, and hence elongates the time up to the clogging of the nozzle hole with ink.

Figure 16:
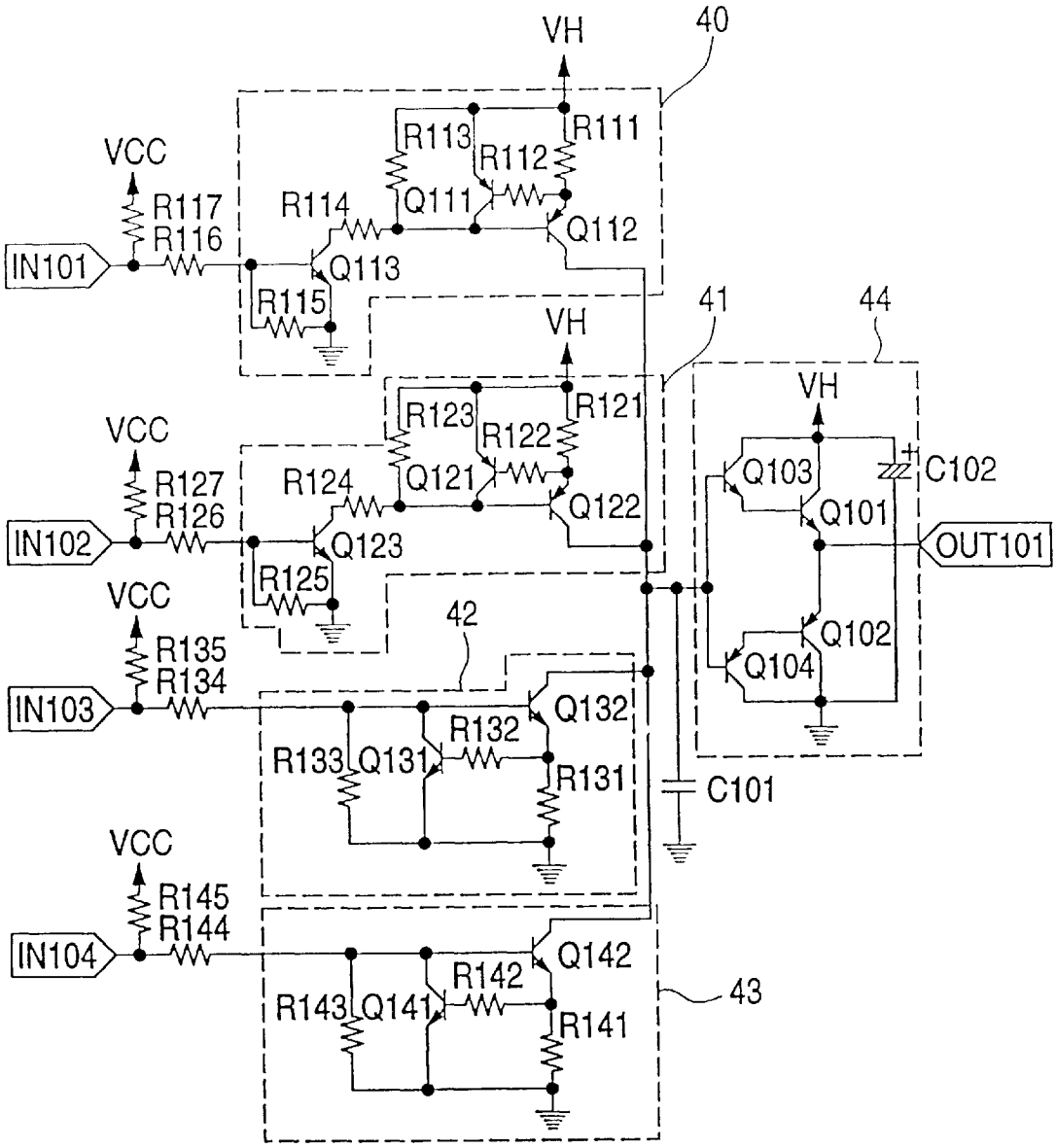
FIG. 16 illustrates an embodiment of a drive signal generating circuit according to the third embodiment of the present invention.

FIG. 16 shows the drive signal generating circuit 26 according to the third embodiment of the invention. A constant current circuit 40 is made up of transistors Q111, Q112 and Q113, and resistors R111 to R117. The constant current circuit receives a signal of high level at the input terminal IN101 and operates in response to the signal, and outputs a current I1; which is determined by resistance r111 of the resistor R111 and a base-emitter voltage VBE111 of the transistor Q111, given by $$I1=VBE111/r111.$$

A capacitor C101 is charged by the current I1.

When the capacitor C101 is charged by the current I1, the voltage across the capacitor C101 increases at a gradient given by $$dV/dt=I1/c101$$

where c101 is the capacitance of the capacitor C101.

A second constant current circuit 41 is made up of transistors Q121 to Q123, and resistors R121 to R127. The second constant current circuit 41, like the first constant current circuit 40, receives an input signal at the input terminal IN102 and feeds a fixed charging current to the capacitor C101.

A third constant current circuit 42 is made up of transistors Q131 and Q132, and resistors R131 to R135. The third constant current circuit is a constant current circuit of the sink type which operates in response to a signal of high level, which is received at the input terminal IN103 of the constant current circuit. The capacitor C101 is discharged through the resistor R131. At this time, a discharging current I3 is defined by $$I3=VBE131/r131$$

where r131 is resistance of the resistor R131; and

VBE131 is base-emitter voltage of the transistor Q131.

When the capacitor C101 is discharged, the voltage across the capacitor C101 decreases at a gradient given by $$dV/dt=I3/c101$$

where c101 is the capacitance of the capacitor C101.

A fourth constant current circuit 43 is made up of transistors Q141 and Q142, and resistors R141 to R145. Like the third constant current circuit 42, the fourth constant current circuit 43 is a constant current circuit of the sink type. Thus, the capacitor C101 is charged and discharged by the currents of the first to fourth constant current circuits. A voltage across the capacitor C101 is applied to a current buffer 44 composed of transistors Q101 to Q104, and is output at the terminal OUT101 thereof in the form of a drive signal. The drive signal is applied to the piezoelectric vibrators 9.

Figure 17:
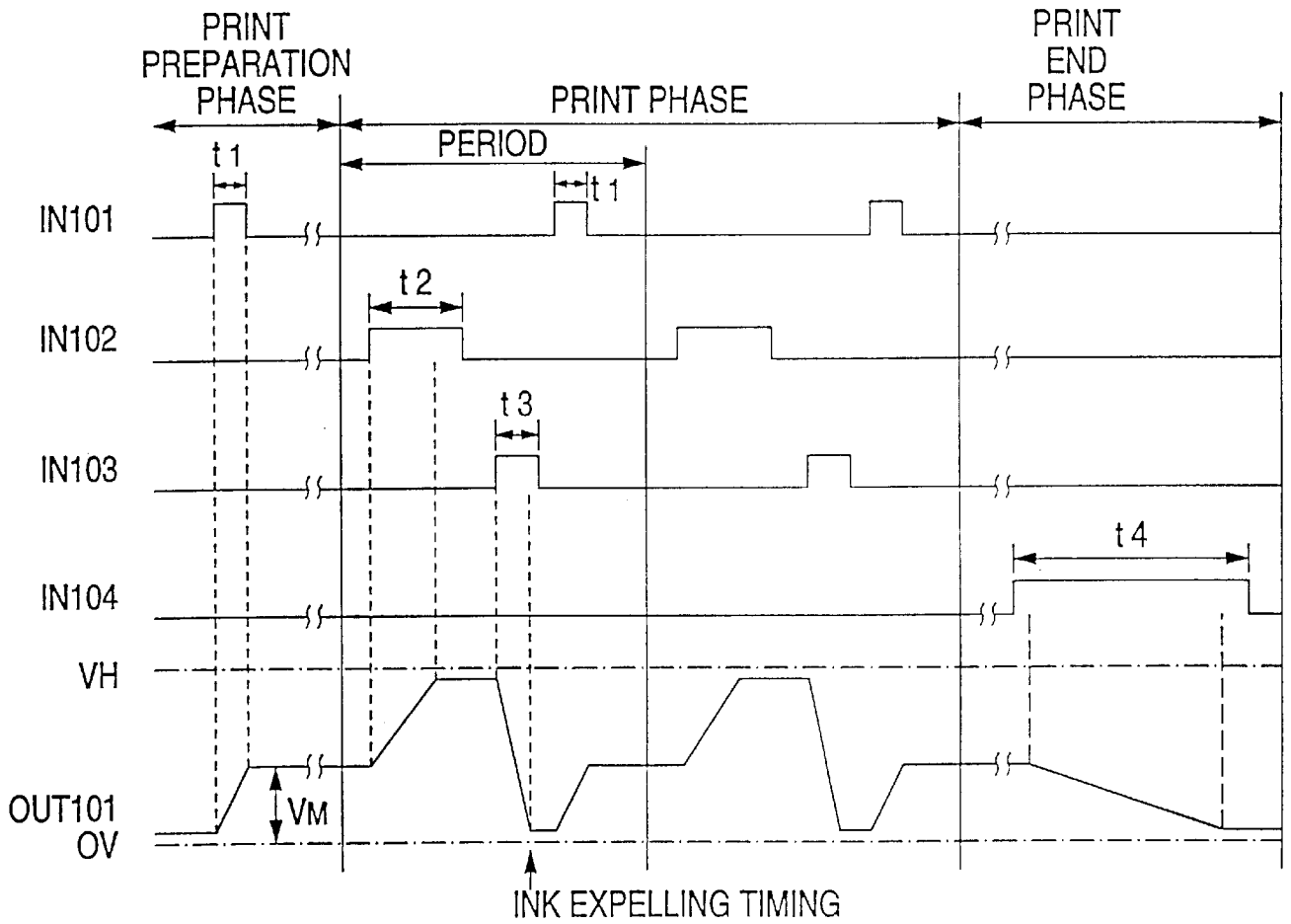
FIGS. 17(*a*) to 17(*f*) illustrate a set of waveforms showing an operation of the drive signal generating circuit illustrated in FIG. 16.

The operation of the drive signal generating circuit thus constructed will be described with reference to FIGS. 17(*a*)–17(*f*).

In a print preparation phase of the printing device, a signal that keeps a high level for a preset period t1 of time is input to the input terminal IN101. Then, the constant current circuit 40 feeds the current I1 to the capacitor C101. By the current I1, the capacitor C101 is charged and a voltage at the output terminal OUT101 is increased to the medium potential VM with time, and a first signal is output. After time t1, the signal at the input terminal IN101 goes low, the charging of the capacitor C101 is stopped, and subsequently the output voltage is kept at the medium potential VM.

In this state, the device operation enters a print phase. Then, a signal of high level is applied to the input terminal IN102 for time t2, longer than a time necessary for the voltage across the capacitor C101 to increase from the medium potential VM to the power source voltage VH. Accordingly, the voltage of the drive signal is increased from the medium potential VM to a voltage approximate to the power source voltage VH, and subsequently the voltage approximate to the power source voltage VH is sustained. As a result, the pressure generating chamber 3 is expanded by a volume corresponding to a potential difference between the medium potential VM and the power source voltage VH.

In synchronism with the jetting out of an ink droplet, a signal of high level is input to the input terminal IN103 for time t3, longer than a time necessary for the voltage across the capacitor C101 to drop to about 0 V. Accordingly, the drive signal is decreased to about 0 V, and a third signal is generated.

Thereafter, at a time point where the motion of the meniscus caused after the jetting out of the ink droplet is completed, the high level signal of time t1 is input to the input terminal IN101. Then, the voltage of the drive signal is increased up to the medium potential VM, and a third signal is generated. By the third signal, the pressure generating chamber 3 is minutely expanded, and the meniscus is pulled to the pressure generating chamber.

Subsequently, in the print phase of the printing device, the first, second and third signals are output every print signal.

After printing one line, a signal of high level is applied to the input terminal IN104 for time t4, longer than a time necessary for the voltage across the capacitor C101 to drop to 0 V. The voltage of the drive signal drops to about 0 V. Since the voltage drop minutely compresses the pressure generating chamber 3, the fourth constant current circuit 43 is designed to have such a time constant as to fail to shoot forth ink. The voltage gently drops.

Figure 18:
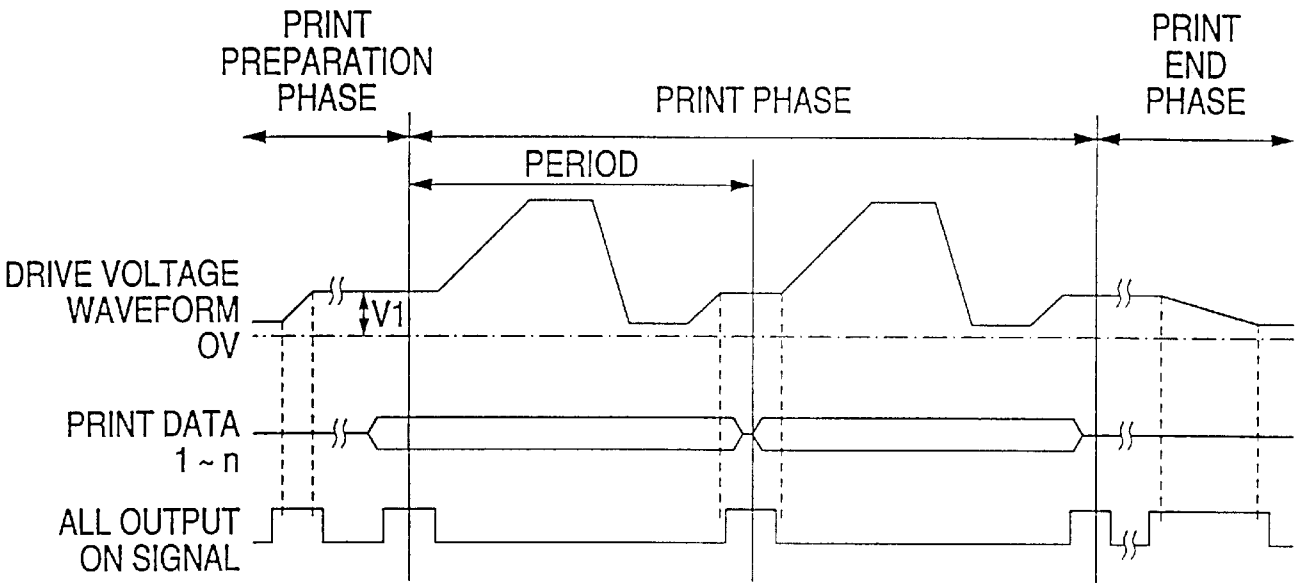
FIGS. 18(*a*) to 18(*c*) illustrate a set of waveforms showing an operation of the drive signal generating circuit in one print cycle according to the third embodiment of the invention.
Figure 19:
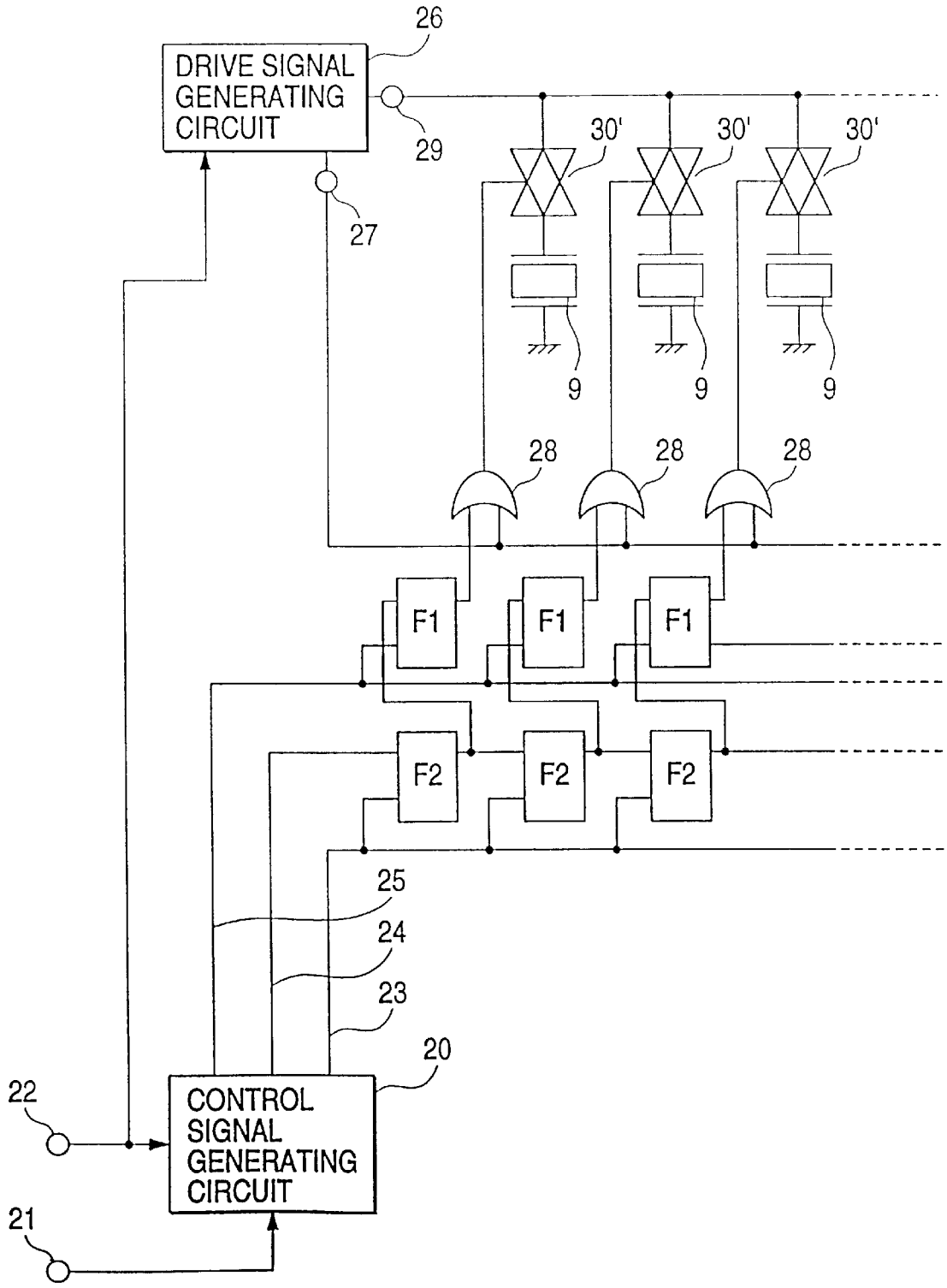
FIG. 19 illustrates an ink jet printing device to which the drive signal generating circuit shown in FIG. 16 is well adaptable.

FIGS. 18(*a*)–18(*c*) show timing charts of a printing operation of the ink jet printing device, which uses the drive signal generating circuit just described. In the print preparation phase, as referred to above, during the period that the drive voltage rises from 0 V to the medium potential VM, an all-output-on signal is rendered high, so that all of the bidirectional switching transistors 30' (FIG. 19) are turned on. In this state, irrespective of print data, the medium potential VM is applied to all of the piezoelectric vibrators 9 to charge the vibrators up to the medium potential VM.

In a normal print phase, when the all-output-on signal is in an on state, the drive signal is applied to specific piezoelectric vibrators 9 through the bidirectional switching transistors 30', which were selectively rendered conductive by print data 1 to n, to thereby charge these vibrators. The piezoelectric vibrators 9, not selected, are not charged and remain at the medium potential VM.

At the start and the end of one print period of one print cycle, the all-output-on signal is turned on at least one time during a period that the drive signal is kept at the medium potential VM. By turning on the all-output-on signal in this manner, those piezoelectric vibrators which have not been driven for a long time, resulting in a decrease from the medium potential VM because of discharge, are charged again to increase the reduced medium potential. That is, each piezoelectric vibrator is refreshed.

In a print end phase, when the drive signal voltage drops from the medium potential VM to about 0 V, the all-output-on signal goes high. As a result, the residual charge in all of the piezoelectric vibrators 9 are completely discharged, and the voltage across each piezoelectric vibrator 9 is at 0 V, to thereby prevent the generation of fine ink droplets, which results from unwanted expansion and compression of the piezoelectric vibrator caused by noise.

Rates of change of the voltage variations of the first signal that increases from the medium potential VM to the voltage VH, the second signal that decreases from the voltage VH to 0 V, and the third signal that increases from about 0 V to the medium potential VM, can be set individually. Accordingly, the drive signal may be more properly set so as to conform to the characteristics of the print heads. In the embodiment shown in FIG. 16, the signal generating circuit for generating the signals to be input to the input terminals IN101 to IN104 is not referred to. It is readily seen, however, that the signal generating circuit may be constructed with one-shot multivibrators connected in a cascade fashion as shown in FIG. 4.

Figure 20:
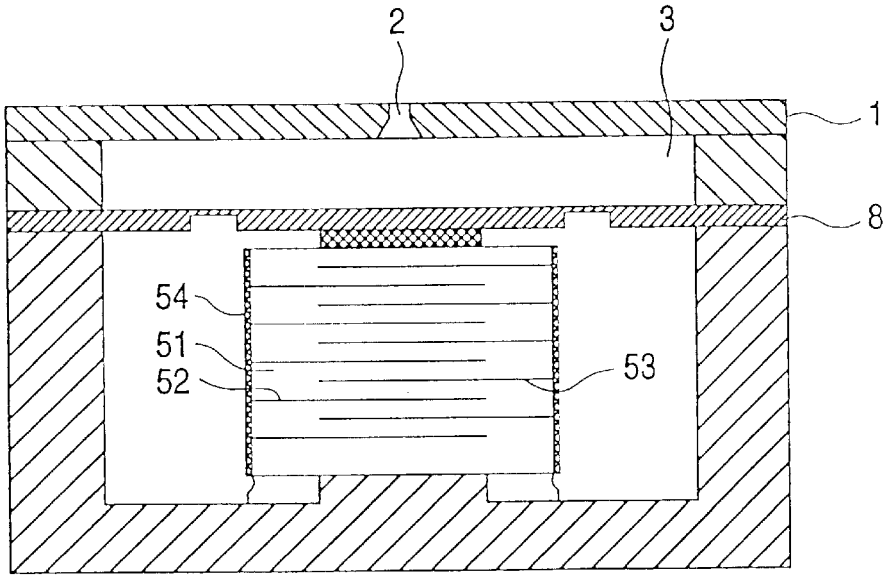
FIG. 20 is a sectional view showing an additional embodiment of the print head to which a drive technique of the invention is applied.

In the embodiments described above, the invention is applied to an ink jet printing device which jets out ink droplets when the pressure generating chamber is expanded and contracted in response to the charging and discharging of the. piezoelectric vibrator. It is evident that the invention may be applied to a print head using a piezoelectric vibrator 54 as shown in FIG. 20. The piezoelectric vibrator 54 consists of piezoelectric sheet-like members 51 and electrode sheet-like members 52 and 53, alternately layered one on another in the vibration direction, as shown in FIG. 20. The piezoelectric vibrator 54 is expanded when charged and compressed when discharged.

Figure 21:
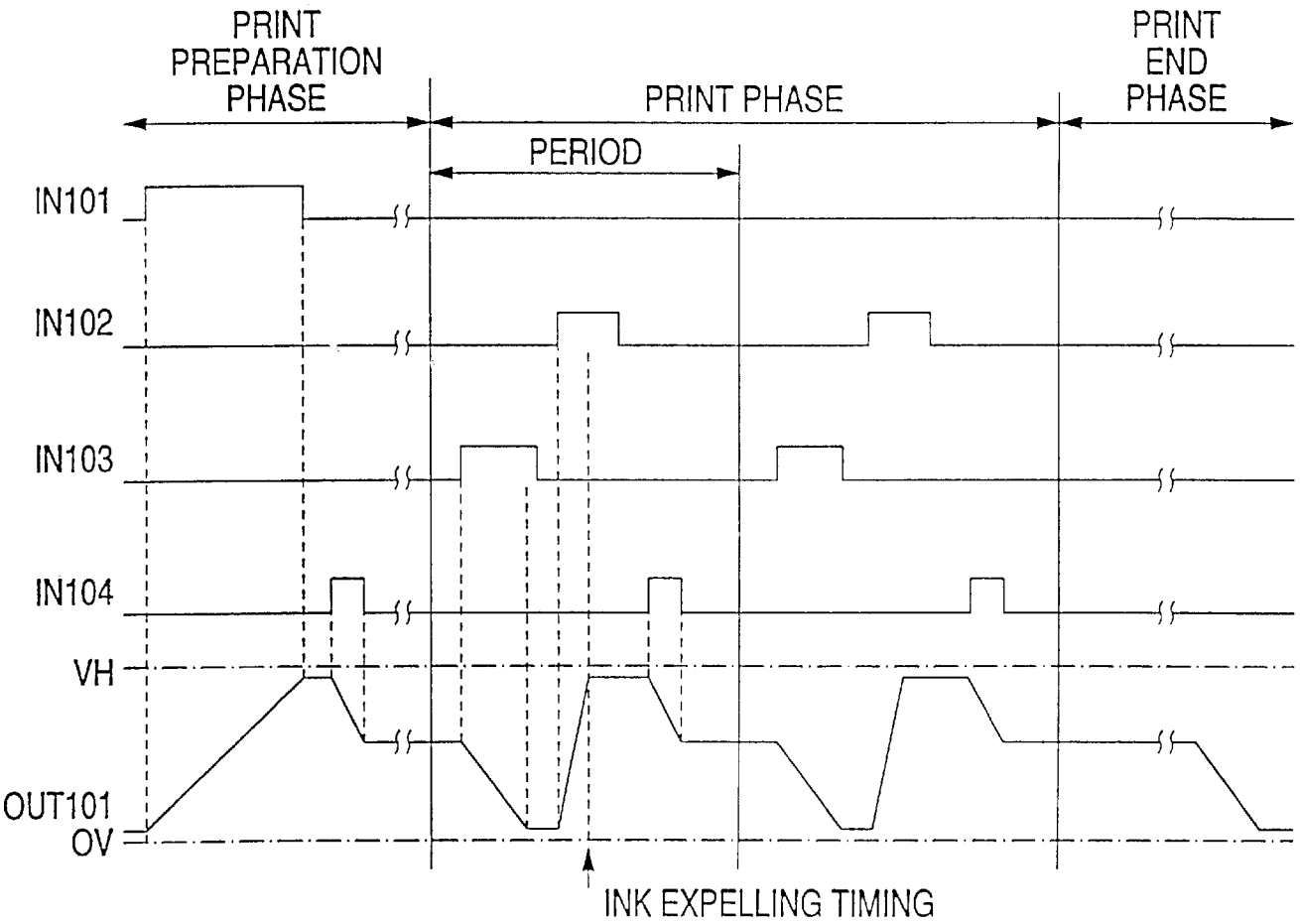
FIGS. 21(*a*) to 21(*f*) illustrate a set of waveforms for explaining a controlling method used when the drive signal generating circuit shown in FIG. 16 is used for driving the print head.

In this case, signals are input to the input terminals IN101 to IN104 at the timings as shown in FIGS. 21(*a*)–21(*f*).

Figure 22:
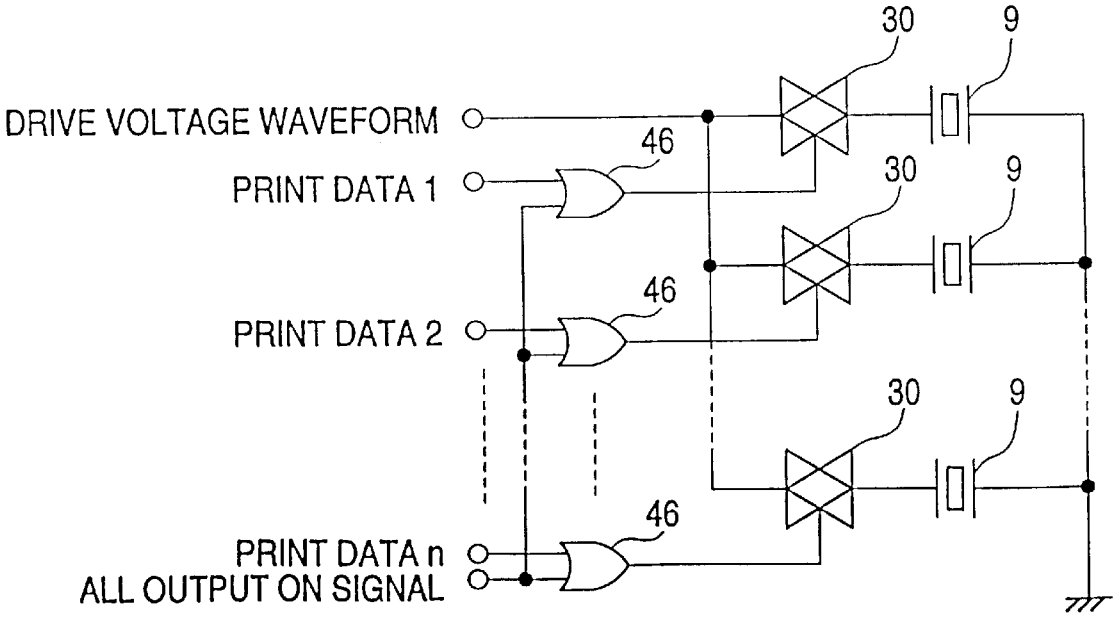
FIG. 22 is a block diagram showing an embodiment of a method of applying print data.

In the embodiments described above, control data is serially transferred to the switching transistors 30 for driving the piezoelectric vibrators. Where the number of piezoelectric vibrators of the print head is not large, a circuit arrangement as shown in FIG. 22 may be used. In the circuit, the drive signals are output to the piezoelectric vibrators by directly inputting print data and the all-output-on signal to the control gates of the switching transistors 30, and the serial-parallel converting means, for example, so that the shift register is not used.

In the above-mentioned embodiments, the timings of outputting the signals are controlled by the one-shot multivibrators. It is apparent, however, that any other suitable timing control means, for example, a microcomputer, may be used for the same purpose.

Figure 23:
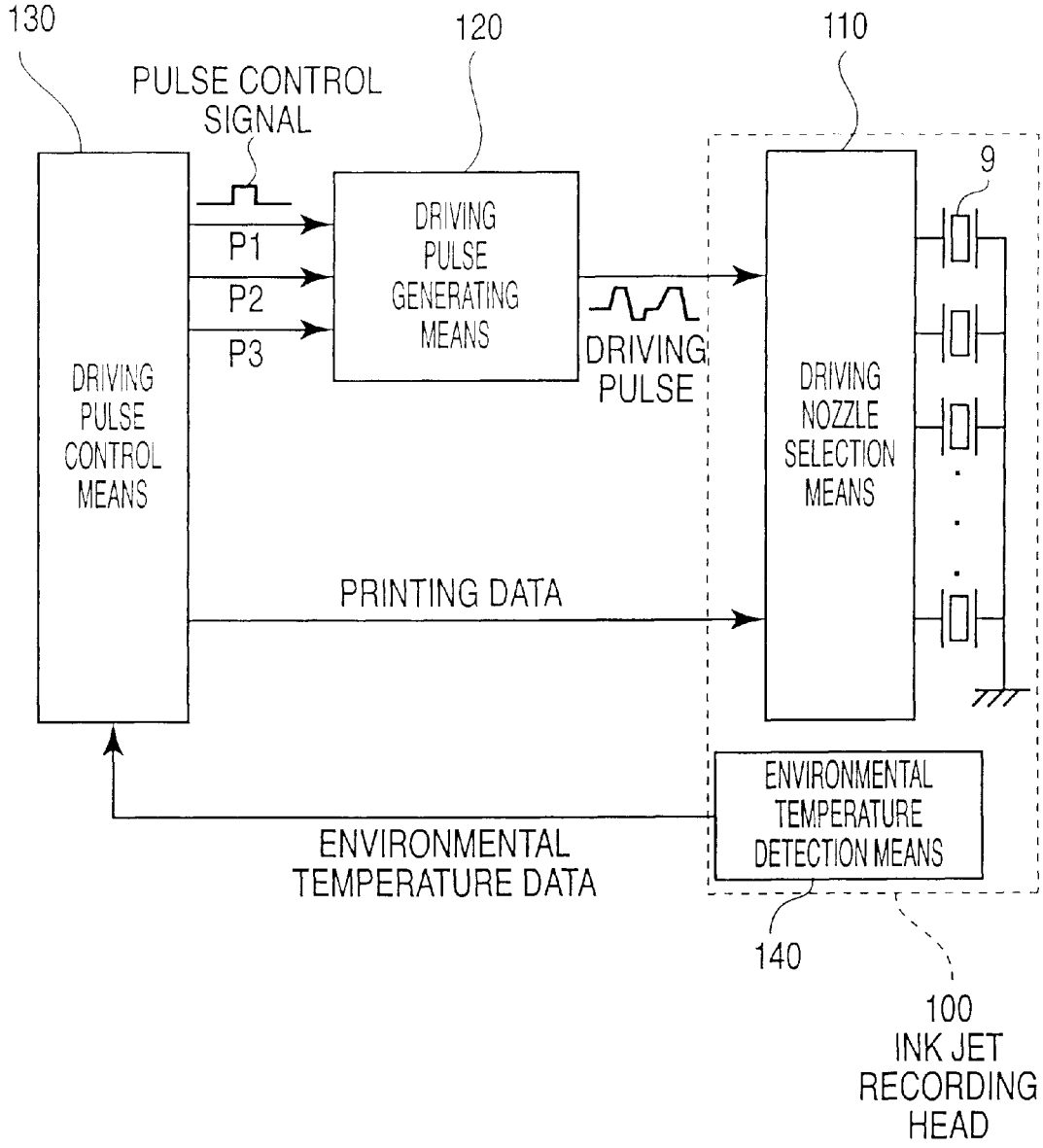
FIG. 23 illustrates a fourth embodiment of the present invention.

FIG. 23 illustrates the ink-jet recording apparatus according to a fourth embodiment of the invention and includes an ink-jet recording head 100 as referred to in FIG. 1, a driving-nozzle selection means 110 for selecting the driving of the piezo-electric vibrators 9, 9, 9 . . . corresponding to the respective nozzles, a driving-pulse generating means 120 for generating a driving pulse, a driving-pulse control means (CPU) 130 for controlling the driving pulse, and an environmental temperature detection means 140.

The environmental temperature detection means 140 is used for detecting the environmental temperature and sends environmental temperature data to the driving-pulse control means (CPU) 130.

The driving-pulse control means (CPU) 130 sends pulse control signals P1, P2, P3 . . . respectively having pulse widths pw1, pw2, pw3 . . . corresponding to the environmental temperatures to the driving-pulse generating means 120 according to a table of relations between the pulse widths of the pulse control signals P1, P2, P3 . . . and environmental temperatures. In addition, the driving-pulse control means (CPU) 130 sends printing data to the driving-nozzle selection means 110 according to printing signals from the outside.

Upon receipt of the plurality of pulse control signals P1, P2, P3 . . . , the driving-pulse control means (CPU) 130 generates a driving pulse having a crest and a base as desired.

The driving pulse thus generated is selectively sent via the driving-nozzle selection means 110 to the piezoelectric vibrator 9 which belongs to the nozzle 2 used to form dots, whereby ink drops are discharged from the desired nozzle 21.

According to this embodiment of the invention, the driving-nozzle selection means 110 and the environmental temperature detection means 140 are mounted on the ink-jet recording head 100. The reason for the installation of the environmental temperature detection means 140 on the ink-jet recording head 100 is that the environmental temperature around the ink-jet recording head 100 is detected with accuracy.

Figures 24A, 24B, 24C, 24D:
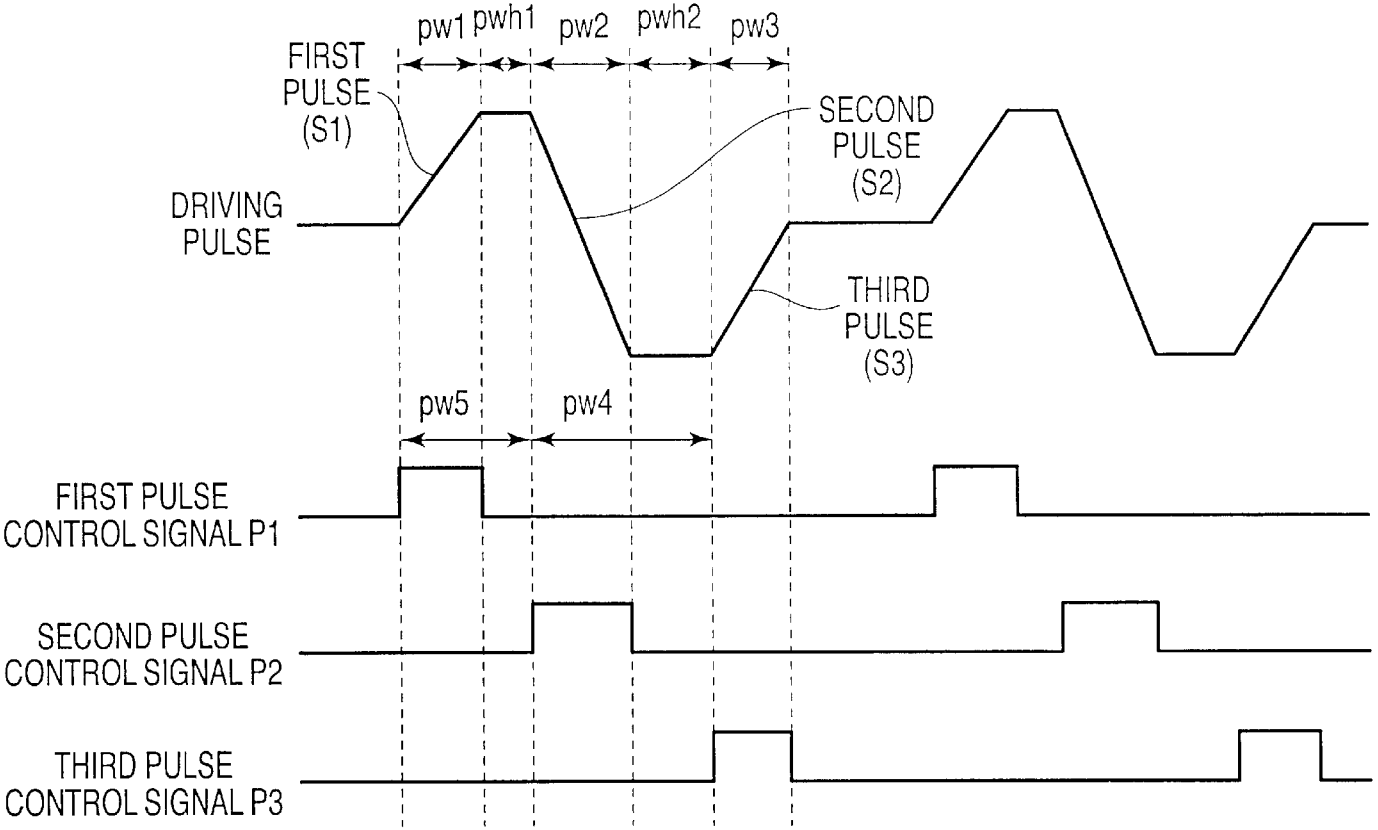
FIGS. 24(*a*)–(*d*) illustrate a driving pulse of the ink jet recording head of the ink-jet recording apparatus according to the fourth embodiment of the invention.

FIG. 24 is a diagram explanatory of the formation of a driving pulse in the ink-jet recording head of the ink-jet recording apparatus according to the fourth embodiment.

The driving pulse in the ink-jet recording head according to the present invention is a stepped trapezoidal pulse having a crest and a base as shown in FIG. 24(*a*) and has a first pulse S1 used for charging, a second pulse S2 used for discharging ink and a third pulse S3 for recharging.

According to the present embodiment, three of the pulse control signals P1, P2, P3 are set within the driving-pulse control means (CPU) 130, these pulse control signals corresponding to the respective first, second and third pulses S1, S2, S3 of the driving pulse. Further, the start timing and duration of the driving pulses S1, S2, S3 are determined by the application timing of the pulse control signals P1, P2, P3 and their pulse widths pw1, pw2, pw3, respectively.

The ink-jet recording head is driven in each stroke of the driving pulse as described below.

When the first pulse control signal P1 is turned on, time equivalent to the pulse width pw1 is required to charge the piezo-electric vibrator 9 up to a predetermined peak voltage and the piezo-electric vibrator 9 contracts. The pressure generating chamber 3 expands as the piezo-electric vibrator 9 contracts, and the meniscus in the nozzle 2 is drawn toward the pressure generating chamber 3 and recovers toward a nozzle tip 21 while vibrating from the position to which the meniscus has completely been drawn. At this time, ink in the common ink chamber 4 is caused to flow into the pressure generating chamber 3 via the ink supply port 5.

The peak voltage is then held after the termination of the first pulse control signal P1 and the piezo-electric vibrator 9 stops its own deformation and stands by for a time equivalent to the pulse width pw1. The meniscus continues to recover toward the nozzle tip 21.

When the second pulse control signal P2 is turned in succession in the course of recovery of the meniscus, time equivalent to the pulse width pw2 is required to discharge the piezo-electric vibrator 9 up to zero-voltage and the piezo-electric vibrator 9 starts extending. The pressure generating chamber 3 starts contracting as the piezoelectric vibrator 9 extends and ink drops are discharged from the nozzle 2 since the pressure is generated in the pressure generating chamber 3. Then the meniscus starts vibrating in the nozzle 2 after the ink drops are discharged.

The meniscus which vibrates after the ink drops are discharged starts moving toward the nozzle tip 21 this time when it has completely been drawn. If, however, the third pulse control signal P3 is set to be turned on at this point of time, time equivalent to the pulse width pw3 is required to charge the piezo-electric vibrator 9 up to a predetermined intermediate potential and since the piezoelectric vibrator 9 contracts by a very small amount, the pressure generating chamber 3 expands. Due to the expansion of the pressure generating chamber 3, the kinetic energy of the meniscus moved toward the nozzle tip 21 is decreased and the residual vibration of the meniscus can be attenuated rapidly as shown by a solid line L1 of FIG. 25.

In the driving method above, the means of regulating the application timing of the second and third pulses (S2), (S3) are utilized for making constant the drawing position of the meniscus when the ink drops are discharged and effectively controlling the residual vibration of the meniscus after the ink drops are discharged.

A description will first be given of this embodiment of the present invention wherein the second pulse (S2) is regulated.

According to the fourth embodiment of the present invention, the start time pw5 (=pw1+pwh1) of the second pulse (S2) can be regulated from the time when the first pulse (S1) is started, and the application timing (hereinafter called the "discharge timing") of the second pulse (S2) can also be regulated.

Figure 26A:
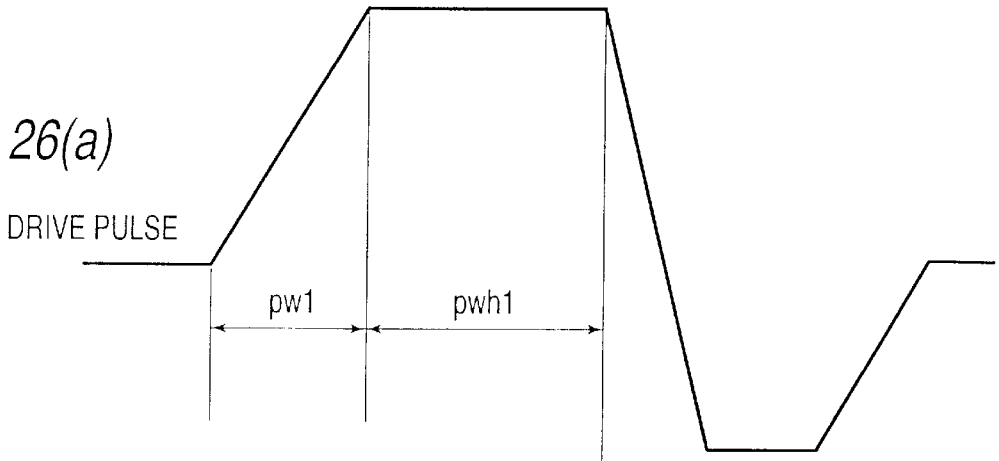
FIGS. 26(*a*)–(*b*) illustrate the relationship among the driving pulse, behavior of the meniscus and the drawing position of the meniscus at the time of ink discharge according to the fourth embodiment of the invention.
Figure 26B:
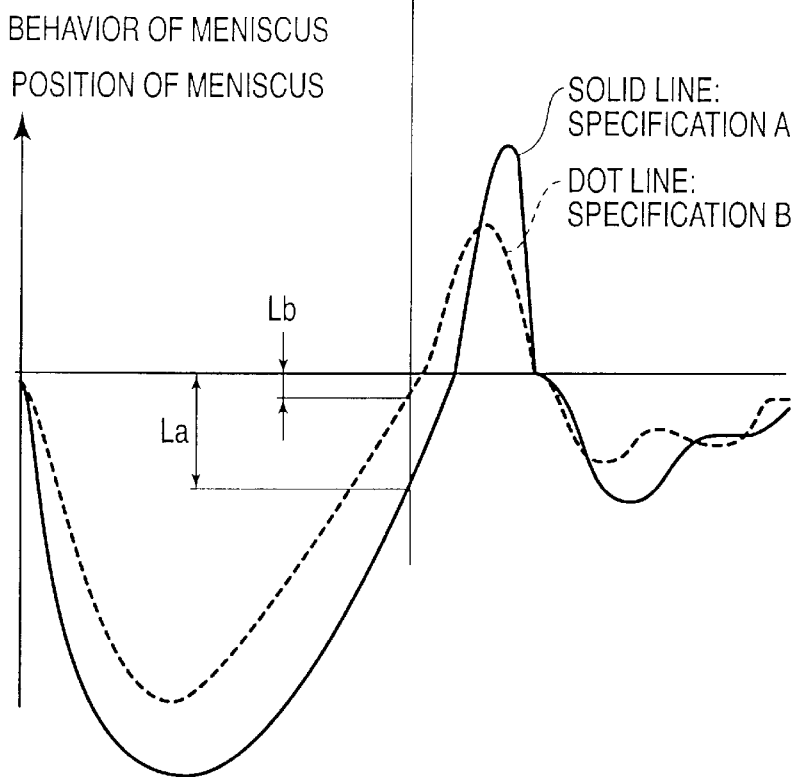
Figure 27A:
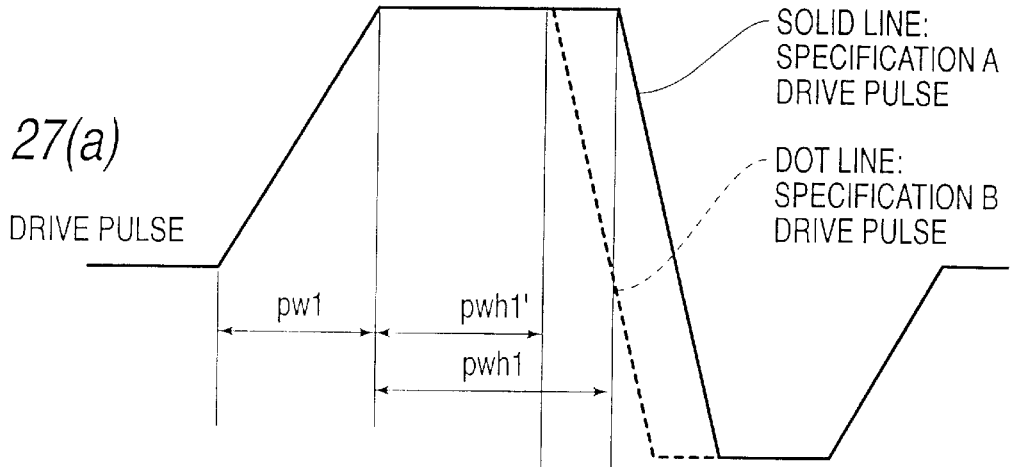
FIGS. 27(*a*)–(*b*) illustrate the relationship among the driving pulse, behavior of the meniscus and the drawing position of the meniscus at the time of ink discharge according to a fifth embodiment of the invention.
Figure 27B:
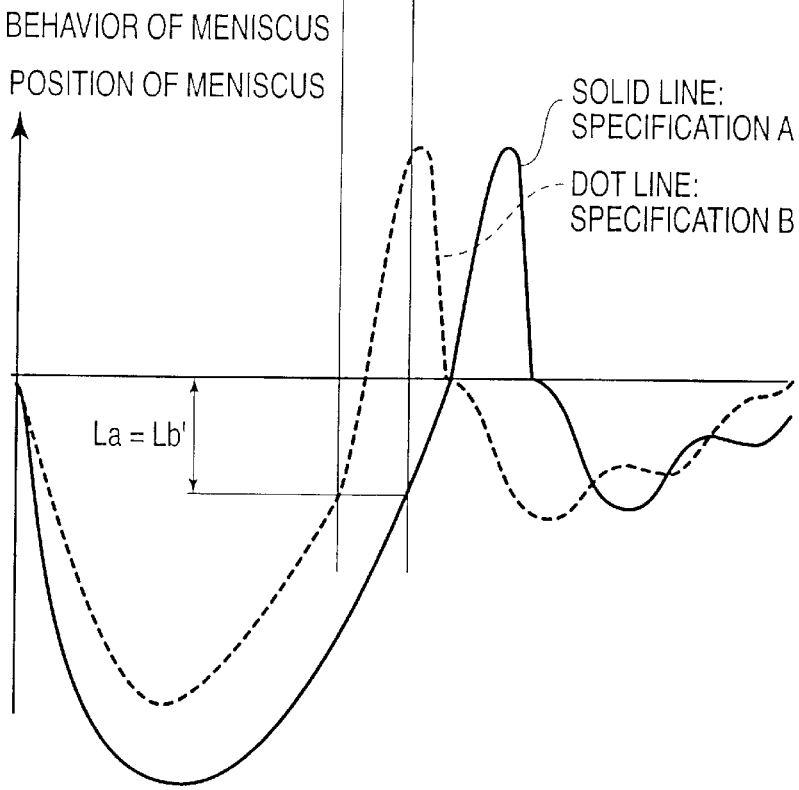

FIGS. 26, 27 are diagrams explanatory of the relation among the driving pulse in the ink-jet recording head 100, behavior of the meniscus and the drawing position of the meniscus at the time of discharging ink in an ink-jet recording apparatus embodying the present embodiment.

The drawing of the meniscus caused by the driving of the first pulse and its recovery behavior are affected by a flow-channel impedance peculiar to the ink-jet recording head.

The flow-channel impedance is a value which is substantially determined by the inertance Mn and resistance Rn of the nozzle 2, and the inertance Ms and resistance Rs of the ink supply port 5, which flow-channel impedance Z is given by $$Z=(Rn+Rs)+(Mn\times\omega+Ms\times\omega)$$

where ω=1/TH, and TH=Helmholtz resonance period as described above.

The inertance Mn·Ms and the resistance Rn·Rs are caused to fluctuate by variations in the flow-channel dimensions of the nozzle 2, the ink supply port 5 and the like and moreover by variations in the physical properties (viscosity and density) of ink because of the environmental temperature. Consequently, the drawing and recovery behavior of the meniscus tend to vary.

Notwithstanding, a difference in the drawing position of the meniscus occurs and the discharge speed of ink drops as well as the discharged quantity of ink varies as shown in FIG. 26(*b*) (comparatively shown by La and Lb therein) because of a difference in the behavior of the meniscus when the driving method is implemented by making the discharge timing constant at all times.

The driving method above results in variations in not only the landing position of ink drops but also the head-to-head image, so that it is quite capable of lowering the production yield of the ink-jet recording head.

Since any discharge timing can be set according to the present invention, even though the behavior of the meniscus varies because variations in the flow-channel dimensions of the nozzle 2 and the ink supply port 5 and the physical properties of ink, it is possible to cause the discharge of ink drops at the same drawing position at all times as in the case of FIG. 27(*b*) by regulating the discharge timing (pwh1→pwh1') as shown in FIG. 27(*a*), whereby the discharge speed of the ink drops can be kept constant at all times (comparatively shown by La and Lb in FIG. 26(*b*).

Consequently, the landing position of ink drops is stabilized and a stable image can be expressed at all times. Moreover, slight variations in the flow-channel dimensions can be dealt with by altering the driving pulse without lowering the production yield.

The application timing of the second pulse (S2) of the driving pulse that has been output from the driving-pulse generating means 120 is also varied via the driving-pulse control means (CPU) 130 by providing the environmental temperature detection means 140 so as to detect the environmental temperature.

Thus, the drawing position of the meniscus can be set constant at the discharge timing even the environmental temperature varies, so that an image of high quality and always stability against environmental variation is formable.

With reference to the fourth embodiment of the present invention, the present inventor have inquired into the relation between the application timing of the second pulse and the discharge speed concerning the widths of ink supply ports and ink-jet recording heads according to a plurality of specifications with different nozzle diameters.

FIGS. 28(*a*), (*b*) are diagrams explaining the relationship between the widths of the ink supply ports and the heads according to the plurality of specifications with different nozzle diameters in the driving method with the fixed application timing of the second pulse.

In this testing, the discharge speed of the head in each specification was confirmed when the same quantity of ink was discharged with the application timing of the second pulse (S2) being at two points. FIG. 28(*a*) results from pw5=(pw1+pwh1)=(15+10)=25μs and FIG. 28(*b*) from pw5=(pw1+pwh1)=(15+20)=35μs.

Since ink drops are discharged at a position where the meniscus is rather more drawn in the driving method of FIG. 28(*a*) in which the application timing of the second pulse (S2) is fast, that is, pw5 is short, the discharge speed is generally high.

In the driving method in both cases of application timing, the discharge speed tends to become slowed as the width of the ink supply port as well as the nozzle diameter is set greater. Moreover, the discharge speed greatly varies with the difference in both the dimensions by several μm and in the case of several μm variations that have been evaluated in the tests above, the discharge speed is seen to vary even in the range of 3–4 m/s.

Figure 29:
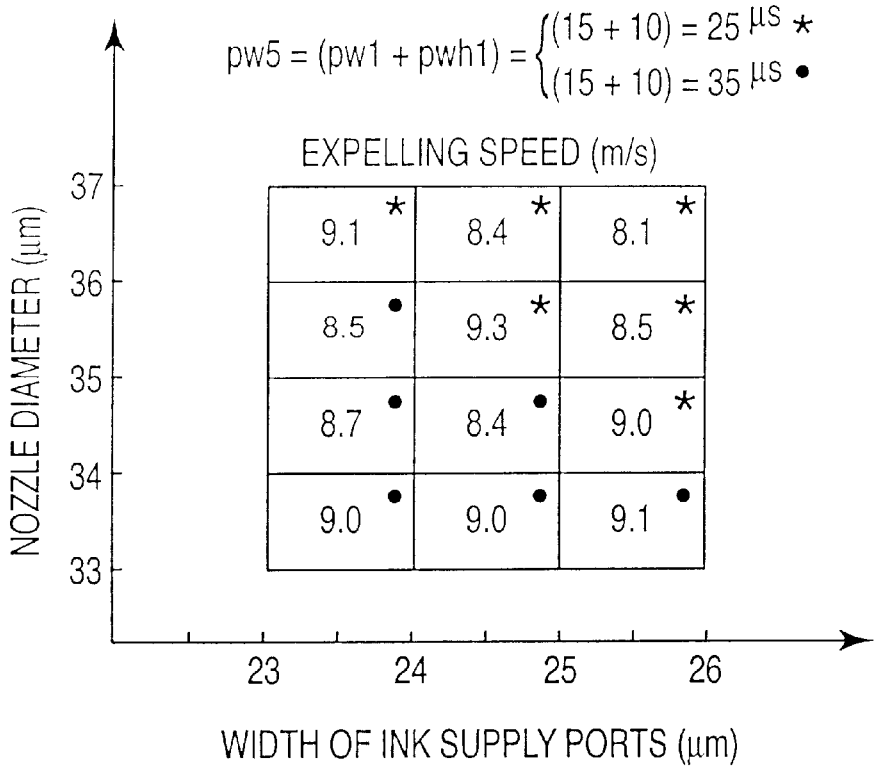
FIG. 29 illustrates the relationship between each ink supply port and the discharge speed through different nozzle diameters according to the fifth embodiment of the invention.

FIG. 29 is a diagram explaining the relationship between each ink supply port and the discharge speed in the head specification of the nozzle diameter when the driving method according to the fourth embodiment of the present invention is carried out.

The driving method according to the fourth embodiment of the present invention was used to regulate the discharge speed by regulating pwhl on a head specification basis and shortening the application timing (pw5) of the second pulse with respect to the specification in which the width of the ink supply port and the nozzle diameter are great and the discharge speed is low.

As a result, variations in the discharge speed can be reduced as shown in FIG. 28 and variations in the discharge speed can be set in a range of 1 m/s or less as observed in the tests above (in FIG. 29, the discharge speed marked with * and ⊙ are those which have so regulated as to be driven at pw5=25, 35 μs, respectively).

Thus, variations in the discharge speed can be lowered even if the head specification is varied by regulating the application timing (pw5) of the second pulse.

Although pw5 was regulated at two points in the tests above, variations in the discharge speed is made reducible by regulating it at any smaller point. Although only pwh1 was regulated with pw1 fixed when pw5 was regulated in the tests above, the regulation of pwl may be dealt with by regulating pw1. When pw1 is altered, however, the behavior of drawing the meniscus greatly varies and besides pwh1 also needs regulating. Therefore, a combination of optimum pulses for each flow-channel dimension becomes complicated and consequently it is preferred to deal with regulating pw5 only by regulating pwh1 with pw1 fixed.

A fifth embodiment of the present invention will subsequently be described.

According to the fifth embodiment of the present invention, the start time pw4 (=pw2 +pwh2) of a third pulse can be regulated from the time when a second pulse is started and the application timing of the third pulse can also be regulated.

A detailed description will further be given with reference to the drawings.

Figure 25A:
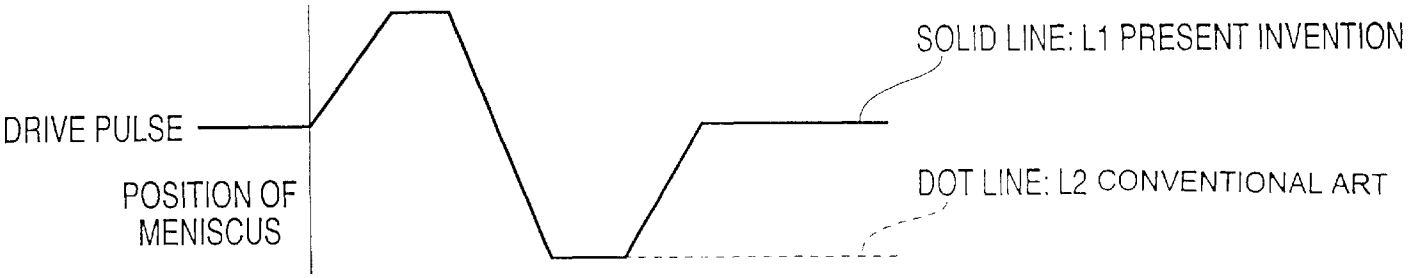
FIG. 25 illustrates the driving pulse and behavior of the meniscus in an ink-jet recording head of an ink-jet recording apparatus according to the fourth embodiment of the present invention.
Figure 25B:
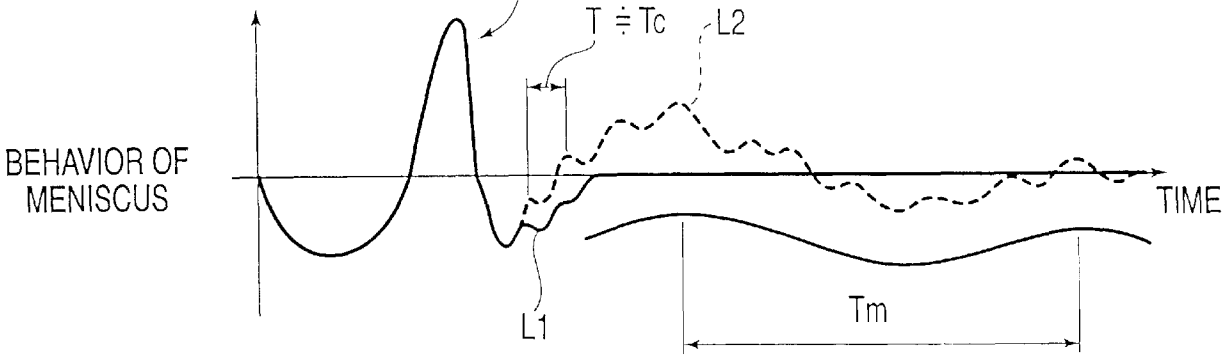

FIG. 25 is a diagram showing the driving pulse and the behavior of a meniscus in an ink-jet recording head of an ink-jet recording apparatus embodying the present invention.

With respect to the application timing of the third pulse, the meniscus is not effectively controllable when a pressure generating chamber 3 is expanded by starting charging at timing at which the meniscus is moving toward the pressure generating chamber 3 or a nozzle tip 21.

In this case, the kinetic energy of the meniscus is not sufficiently reduced and the vibration of the meniscus remains as shown by a broken line of FIG. 25. When the next discharge timing corresponds to the course of drawing the meniscus into a nozzle 2, the shape of the meniscus at the time ink drops are discharged tends to become unstable, which results in producing a mist in the ink drops discharged or readily causing curved or deflected discharging.

For the reason stated above, the stable discharge of ink drops is not sufficiently secured under the driving frequency of discharging the next ink drops at the aforementioned timing and the problem is that a deterioration of printing quality is easily incurred.

Therefore, care should be taken to set the application timing of the third pulse and according to the present invention, a means for making use of the Helmholtz frequency with a period TH as the representative vibration characteristic of the meniscus as shown below, whereby the optimum application timing of the third pulse is readily decided and set.

A representative value of the vibration characteristic of the meniscus will subsequently be described.

The representative values calculated above for the Helmholtz period and the Helmholtz frequency are closely connected to the behavioral characteristics of the residual vibration of the meniscus after ink drops are discharged. As shown in FIG. 25, the meniscus after the ink drops are discharged is allowed to repeat vibration with a great period (Tm) while having vibration with a small vibration period (T).

As described above, the application timing of the third pulse is such that the state in which the meniscus has been drawn toward the pressure generating chamber 3 is most effective. Therefore, the timing of the third pulse at which the vibration of the meniscus is effectively controllable exists with such a period as a subtle period T.

In other words, it is meant that the vibration of the meniscus is made effectively controllable by adding the third pulse (i.e., the time pw4 from the start of the second pulse up to the start of the third pulse in FIG. 24 is substantially set equal to T) after the passage of time equivalent to the vibration period of T from the time the ink drops are discharged.

The subtle vibration period (T) of the meniscus is nothing but the aforementioned Helmholtz resonance period (TH). In other words, the optimum application timing of the third pulse can easily be set provided that the subtle resonance period TH is made confirmable by the aforementioned calculating expression.

Figure 30:
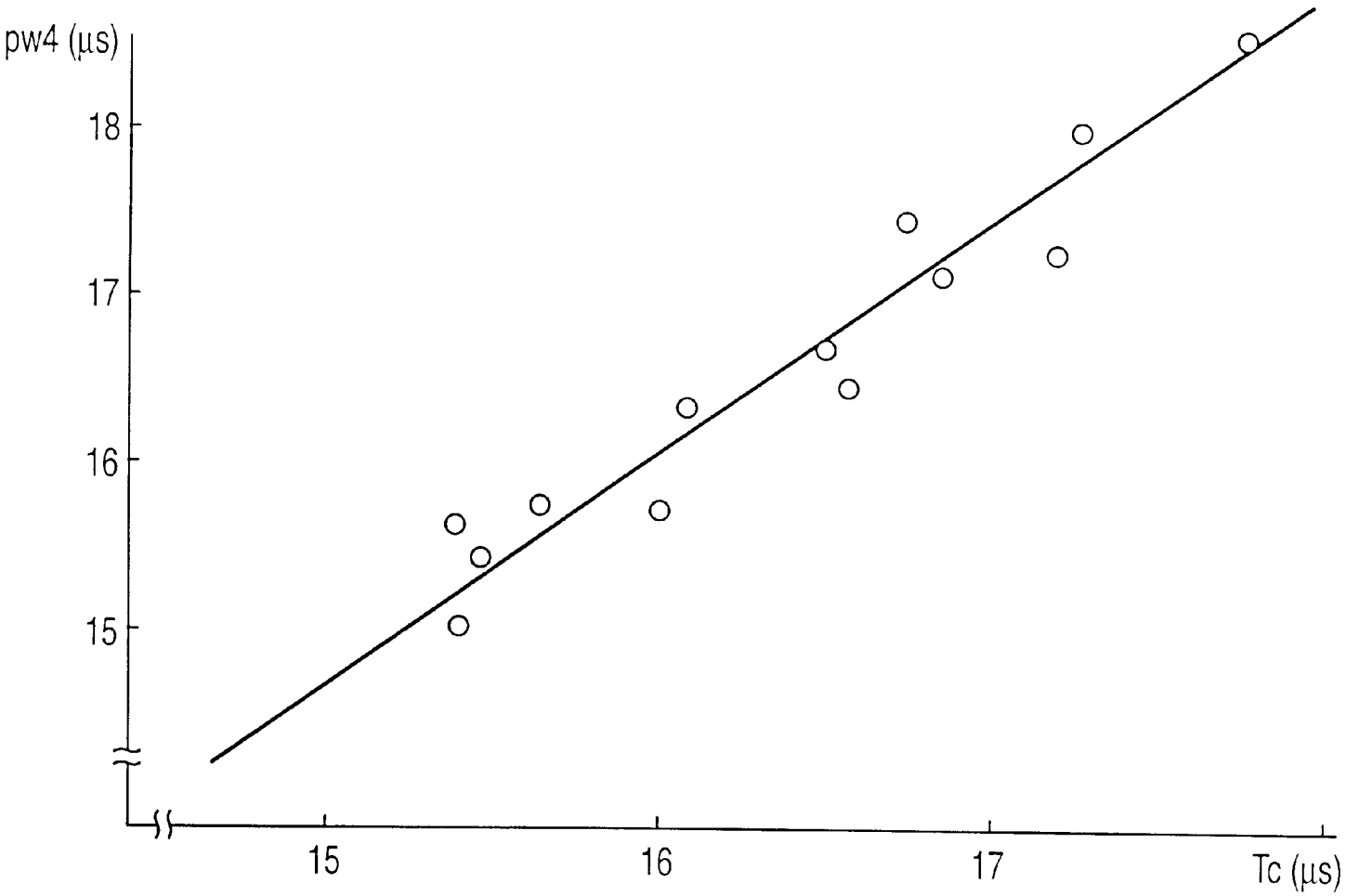
FIG. 30 illustrates the relationship between the resonance period TH and the optimum application timing of the third signal at which ink drops are stably discharged in the ink-jet recording apparatus according to the present invention.

The present inventors have inquired into the resonance period TH that the ink-jet recording head has and the optimum application timing of the third pulse. FIG. 30 is a graph showing the relation between the resonance period TH and the optimum application timing of the third pulse at which ink drops are stably discharged in the ink-jet recording apparatus according to the present invention. In FIG. 30, the optimum application timing of the third pulse is shown with time pw4 from the start of the second pulse up to the start of the third pulse.

In the tests, the duration pw3 of the third pulse is set substantially equal to that of the second pulse. This is because the vibration of the meniscus is effectively controlled in comparison with a case where both the pulses are unequal when the vibration of the meniscus caused by the third pulse becomes opposite in phase to the vibration caused by the second pulse since the vibration of the meniscus caused by both the pulses by applying the pulses in the same duration is generated with a substantially equal period.

As is obvious from FIG. 30, the resonance period TH and the optimum application timing (pw4) of the third pulse are substantially in conformity with each other and according to the present invention it is identified that the optimum application timing of the third pulse can readily be decided and set by the means of utilizing the Helmholtz resonance period TH as the representative value of the vibration characteristic of the meniscus.

In a case where the duration pw3 of the third pulse and the duration pw2 of the second pulse are unequal, the resonance period TH does not conform to pw4. However, since pw4 becomes a slightly shifted value with respect to the resonance period TH, it is easy to make the resonance period Tc a representative value when the shifting quantity is obtained.

The vibration of the meniscus after the discharge of ink drops is, as defined by the aforementioned expression, fluctuates with the variation of compliance arising from the compression properties of ink and the rigidity of the pressure generating chamber 3 and that of inertance originating from the shape and dimensions of the ink flow channel including the nozzle 2, the ink supply port 5 and the like.

The fluctuation is mainly caused by variations in the shape of the ink flow channel in the process of manufacture and the environmental temperature and particularly the compliance fluctuates to a relatively great extent because the rigidity of the material used to form the pressure generating chamber 3, to say nothing of the physical property value of ink, also varies when the environmental temperature varies. Consequently, the resonance vibration period Tc varies, which is followed by variations in the optimum application timing of the third pulse.

The present inventors have inquired into variations in the resonance period Tc of the ink-jet recording head because of the environmental temperature.

Referring again to FIG. 13, this graph shows the relation between the resonance period TH and the environmental temperature in the ink-jet recording apparatus according to the present invention. FIG. 14 is a graph showing the relation between the environmental temperature and the optimum application timing of the third pulse for discharge stability.

Obviously, the resonance period TH becomes longer as the environmental temperature is raised and the optimum application timing pw4 of the third pulse is also seen to vary accordingly.

By this is meant that when the ink-jet recording head is driven with the application timing fixed at a predetermined value, the vibration of the meniscus is not controlled most suitably when the resonance period Tc greatly varies because of variations in the shape of the ink flow channel in the process of manufacture and the environmental temperature; thus, ink drops are discharged unstably.

Referring to FIG. 23, an environmental temperature detection means 140 for detecting the environmental temperature is provided so that the application timing of the third pulse of the driving pulse that is output from a driving-pulse control means driving-pulse control means 130 is varied via the driving-pulse control means 130.

Thus, the driving at the optimum application timing of the third pulse becomes possible against the environmental temperature variation and even when the vibration of the meniscus generated by the discharge of ink drops varies because of the environmental temperature, the pressure generating chamber 3 is expanded again by the third pulse at the time the meniscus is moved closest to the pressure generating chamber 3, so that the kinetic energy of the meniscus moving to the nozzle at this point of time can effectively be attenuated.

Thus, an unstable phenomenon of discharge of ink drops due to the non-conforming attenuation of kinetic energy of the meniscus is suppressed, irrespective of the environmental temperature. Moreover, the flying speed of ink drops is stabilized because the ink drops are discharged in such a state that the meniscus is made to stand still at a predetermined position, irrespective of the repetition of frequency, by suddenly bringing the meniscus to a standstill. Consequently, it is possible to secure stable discharging at high driving frequency.

A description will lastly be given of operations at the time the start of printing is prepared and at the time of printing termination.

The piezo-electric vibrator 9 is slightly contracted by charging the driving pulse up to the intermediate potential before printing is started and kept on standby until the printing signal is sent out. The time required for charging is to the extent that no ink drops are discharged by that driving, that is, the duration of the third pulse is permissible without any problem.

When the printing signal is not input any longer, the potential of the driving pulse is reduced to zero by discharging with the predetermined pulse. The time required then is also to the extent that no ink drops are discharged by that driving without any problem.

The following effect is attainable through the operations above.

The piezo-electric vibrator 9 is caused to slightly extend and contracts through the operations above and the pressure generating chamber 3 is also expanded and contracted. Consequently, the meniscus in the nozzle 2 slightly vibrates and ink in the pressure generating chamber 3 is stirred, so that the ink in the nozzle 2 which is easily dried when exposed to the atmosphere is prevented from being solidified and clogging the nozzle 2.

As described above, the present invention includes drive signal generating means for generating a first signal to expand the pressure generating chambers, a second signal to compress the pressure generating chamber being in an expanded state to compel the pressure generating chamber to shoot forth an ink droplet through the nozzle hole, and a third signal to expand the pressure generating chamber by a volume smaller than the volume expanded by the first signal when the vibration of the meniscus generated after the shooting of an ink droplet moves to the nozzle hole. Therefore, the meniscus going to the nozzle hole for is jetting out the ink droplet is pulled back by the expansion of the pressure generating chamber, to thereby effectively attenuate the vibration of the meniscus. Accordingly, the generation of ink mist caused by the kinetic energy of the meniscus can be prevented. The meniscus for jetting out the next ink droplet is stayed at a proper position, so that the flying of the ink droplet is stabilized.

Additionally, the ink-jet recording apparatus may include a means for controlling the drive signal generating means for selectively controlling the starting time for the second and third signals.

Consequently, ink can be discharged at the timing of equalizing the drawing position of the meniscus which is drawn by the first pulse and is recovering at the time of starting the second pulse. Thus, the discharge speed of ink drops can be made constant at all times.

Since ink can be discharged at the constant drawing position of the meniscus at all times even though the behavior of the meniscus varies with the variation of the environmental temperature, the discharge speed of ink drops can be made constant at all times at any environmental temperature.

On the other hand, since the pressure generating chamber can readily be expanded again by applying the third signal when the residual vibration of the meniscus generated after ink drops are discharged is moved closest to the pressure generating chamber, the kinetic energy of the meniscus which is moving toward the nozzle at this point of time can effectively be attenuated.

Since the third signal can be started at the optimum timing for attenuation with respect to variations in the vibration behavior of the meniscus due to the variation of the environmental temperature, ink drops can be discharged stably at all times.

The flying speed of ink drops is stabilized as the ink drops are discharged in such a state that the meniscus is made to stand still at the predetermined position, irrespective of the repetition of frequency, by suddenly bringing the meniscus to a standstill. Further, the shortened recovery time of the meniscus makes the response frequency improvable.

Since the time from the start of the second signal fit for attenuating and controlling the vibration of the meniscus after the discharge of ink drops up to the start of the third signal substantially conforms to the period TH of the pressure generating chamber, the start time of the third signal can be set with TH as the representative value.

While specific preferred embodiments have been described above, it would be apparent to one skilled in the art that several modifications may be made without departing from the spirit and scope of the present invention. For example, while the preferred embodiment describes a piezo-electric driving source operating in a vertical vibration mode, a similar effect may be achievable if the piezo-electric driving source were operated in a horizontal vibration mode.

What is claimed is:

1. An ink-jet recording apparatus comprising:

a pressure generating chamber having a Helmholtz frequency with a period TH, the pressure generating chamber communicating with a common ink chamber via an ink supply port, said pressure generating chamber also having a nozzle;

an ink-jet recording head having a piezo-electric vibrator for expanding and contracting the pressure generating chamber;

driving pulse generating means for outputting a first pulse for expanding the pressure generating chamber, a second pulse for causing ink drops to be discharged from the nozzle by contracting the pressure generating chamber in an expanded state, and a third pulse for expanding the pressure generating chamber again after the second pulse; and driving-pulse control means for selectively controlling timing of the start of the second pulse and timing of the start of the third pulse.

2. An ink-jet recording apparatus as claimed in claim 1, wherein a timing of the start of the second pulse is controlled by the driving-pulse control means so that a position of a meniscus in the nozzle at the timing of the start of the second pulse is made constant.

3. An ink-jet recording apparatus as claimed in claim 1, wherein the driving-pulse control means sets a timing of the start of the second pulse as desired according to a flow-channel impedance of the nozzle and the ink supply port.

4. The ink jet recording apparatus of claim 3, wherein said third pulse expands said pressure generating chamber by a volume smaller than a volume produced in response to said first pulse.

5. An ink-jet recording apparatus as claimed in claim 2, wherein the driving-pulse control means sets a timing of the start of the second pulse as desired according to a flow-channel impedance of the nozzle and the ink supply port.

6. An ink-jet recording apparatus as claimed in one of claims 1–5, wherein a timing of the start of the second pulse is set fast when a flow-channel impedance of the nozzle or the ink supply port is low, and the timing of the second pulse is set slow when the flow-channel impedance of the second pulse is high.

7. An ink-jet recording apparatus as claimed in claim 6 further comprising environmental temperature detection means for measuring an environmental temperature, wherein the timing of the start of the second pulse is set fast when the environmental temperature rises, and the timing of the second pulse is set slow when the environmental temperature lowers.

8. An ink-jet recording apparatus as claimed in one of claims 1–5, wherein a timing of the start of the second pulse is set fast when a sectional area of one of the nozzle and the ink supply port is large, and the timing of the second pulse is set slow when the sectional area of one of the nozzle and the ink supply port is small.

9. An ink-jet recording apparatus as claimed in claim 8, further comprising environmental temperature detection means for measuring an environmental temperature, wherein the timing of the start of the second pulse is set fast when the environmental temperature rises, and the timing of the second pulse is set slow when the environmental temperature lowers.

10. An ink-jet recording apparatus as claimed in one of claims 1–5, wherein a timing of the start of the second pulse is set fast when one of the nozzle and the ink supply port is long, whereas the timing of the second pulse is set slow when one of the nozzle and the ink supply port is short.

11. An ink-jet recording apparatus as claimed in claim 10, further comprising environmental temperature detection means for measuring an environmental temperature, wherein the timing of the start of the second pulse is set fast when the environmental temperature rises, and the timing of the second pulse is set slow when the environmental temperature lowers.

12. An ink-jet recording apparatus as claimed in one of claims 1–5, further comprising environmental temperature detection means for measuring an environmental temperature, wherein a timing of the start of the second pulse is controlled by the driving pulse control means according to the environmental temperature.

13. An ink-jet recording apparatus as claimed in claim 1, wherein a timing of the start of the third pulse is controlled by the driving-pulse control means so that a vibration of a meniscus generated after the ink drops are discharged substantially conforms to the vibration thereof at a point of time where the meniscus is moved closest to the pressure generating chamber.

14. An ink-jet recording apparatus as claimed in either claim 1 or claim 13, wherein the driving-pulse control means selectively sets a timing of the start of the third pulse according to the period TH of the pressure generating chamber.

15. An ink-jet recording apparatus as claimed in claim 14, further comprising an environmental temperature detection means for measuring an environmental temperature, wherein the timing of the start of the third pulse is controlled by the driving-pulse control means according to the environmental temperature.

16. An ink-jet recording apparatus as claimed in claim 15, wherein the timing of the start of the third pulse is set fast when an environmental temperature rises, and the timing of the third pulse is set slow when the environmental temperature lowers.

17. An ink-jet recording apparatus as claimed in claim 15, wherein the duration of the second pulse is set substantially equal to the duration of the third pulse and wherein the time from the start of the second pulse up to the start of the third pulse is set to substantially conform to the period TH of the pressure generating chamber.

18. An ink-jet recording apparatus as claimed in claim 14, wherein the timing of the start of the third pulse is set fast when an environmental temperature rises, and the timing of the third pulse is set slow when the environmental temperature lowers.

19. An ink-jet recording apparatus as claimed in claim 14, wherein the duration of the second pulse is set substantially equal to the duration of the third pulse and wherein the time from the start of the second pulse up to the start of the third pulse is set to substantially conform to the period TH of the pressure generating chamber.

20. An ink-jet recording apparatus as claimed in claim 1 or claim 13, further comprising an environmental temperature detection means for measuring an environmental temperature, wherein a timing of the start of the third pulse is controlled by the driving-pulse control means according to the environmental temperature.

21. An ink-jet recording apparatus as claimed in claim 20, wherein the timing of the start of the third pulse is set fast when an environmental temperature rises, and the timing of the third pulse is set slow when the environmental temperature lowers.

22. An ink-jet recording apparatus as claimed in claim 20, wherein the duration of the second pulse is set substantially equal to the duration of the third pulse and wherein the time from the start of the second pulse up to the start of the third pulse is set to substantially conform to the period TH of the pressure generating chamber.

23. An ink-jet recording apparatus as claimed in claims 1 or 13, wherein a timing of the start of the third pulse is set fast when an environmental temperature rises, and the timing of the third pulse is set slow when the environmental temperature lowers.

24. An ink-jet recording apparatus as claimed in claim 23, wherein the duration of the second pulse is set substantially equal to the duration of the third pulse and wherein the time from the start of the second pulse up to the start of the third pulse is set to substantially conform to the period TH of the pressure generating chamber.

25. An ink-jet recording apparatus as claimed in claims 1 or 13, wherein the duration of the second pulse is set substantially equal to the duration of the third pulse and wherein a time from the start of the second pulse up to the start of the third pulse is set to substantially conform to the period TH of the pressure generating chamber.

26. An ink-jet recording apparatus as claimed in claim 1, wherein the timing of the start of said second pulse is based upon a lapse of a first predetermined period from a start of said first pulse, and wherein the timing of the start of said third pulse is based upon a lapse of a second predetermined period from a start of said second pulse.

27. An ink-jet recording apparatus as claimed in claim 19, wherein said first predetermined period comprises the duration of said first pulse and a holding time for said first pulse, and wherein said second predetermined period comprises the duration of said second pulse and a holding time for said second pulse.

28. The ink jet recording apparatus of claim 1, wherein said third pulse expands said pressure generating chamber by a volume smaller than a volume produced in response to said first pulse.

29. The ink jet recording apparatus of claim 1, wherein said third pulse expands said pressure generating chamber by a volume smaller than a volume produced in response to said first pulse and further comprising environmental temperature detection means for measuring an environmental temperature, wherein the timing of the start of the second pulse is set fast when the environmental temperature rises, and the timing of the second pulse is set slow when the environmental temperature lowers.

30. The ink jet recording apparatus of claim 29, wherein the timing of the start of the third pulse is set fast when the environmental temperature rises, and the timing of the third pulse is set slow when the environmental temperature lowers.

31. An ink jet printing device comprising:

an ink jet print head comprising:

pressure generating chambers, each of said pressure generating chambers having a Helmholtz resonance frequency of period TH and communicating with a common ink chamber via an ink supply path; nozzle holes respectively corresponding to said pressure generating chambers; and piezoelectric vibrators for expanding and compressing said pressure generating chambers, respectively; and drive signal generating means, connected to said piezoelectric vibrators, for generating a first signal to expand said pressure generating chambers, a second signal for compressing said pressure generating chambers being in an expanded state to jet out ink droplets from respective nozzle holes, and a third signal, for expanding said pressure generating chambers, by a volume smaller than a volume produced in response to said first signal, and at a time when a meniscus generated after jetting out each ink droplet moves toward an associated nozzle hole.

32. The ink jet printing device according to claim 31, wherein the amplitude of said third signal is 0.1 to 0.5 times the amplitude of said second signal.

33. The ink jet printing device according to claim 31, wherein the amplitude of said third signal is 0.2 to 0.4 times the amplitude of said second signal.

34. The ink jet printing device according to claim 31, wherein an active state time duration of said third signal is shorter than said period TH of said Helmholtz resonance frequency.

35. The ink jet printing device according to claim 31, wherein an active state time duration of said third signal is substantially equal to an active state time duration of said second signal.

36. The ink jet printing device according to claim 31, wherein a time difference from an output of said second signal to an output of said third signal is substantially equal to said period TH of said Helmholtz resonance frequency.

37. The ink jet printing device according to claim 31, wherein an active state time duration of said first signal is substantially equal to said period TH of said Helmholtz resonance frequency.

38. The ink jet printing device according to claim 31, wherein an active state time duration of said second signal is substantially equal to the period of natural vibration of said piezoelectric vibrators.

39. The ink jet printing device according to claim 31, wherein an active time duration of said third signal is substantially equal to the period of natural vibration of said piezoelectric vibrators.

40. The ink jet printing device according to claim 31, further comprising:

a control signal generating means for generating a latch signal, a print signal and a shift clock signal;

a plurality of first flip-flops, respectively corresponding to said piezoelectric vibrators, which receive said shift clock signal and said print signal, each of said plurality of first flip-flops outputting a print signal;

a plurality of second flip-flops, respectively coupled to said piezoelectric vibrators, each of said second flip-flops receiving said print signal from an associated one of said first flip-flops and further receiving said latch signal; each of said second flip-flops outputting a control signal; and a plurality of switching transistors each receiving said control signal output by an associated one of said second flip-flops for controlling activation of respective ones of said piezoelectric vibrators;

wherein said first flip-flops form a shift register and said second flip-flops form a latch circuit such that said print signals from said first flip-flops are latched by said second flip-flops, respectively.

41. The ink jet printing device according to claim 40, further comprising:

a plurality of OR gates connected to said drive signal generating means and to respective ones of said second flip-flops, wherein said switching transistors are selectively activated by output signals from said OR gates.

42. The ink jet printing device according to claim 31, wherein said drive signal generating means comprises:

a timing control circuit;

charging means connected to said timing control circuit;

discharging means connected to said timing control circuit;

a capacitor connected to both said charging means and said discharging means; and an output terminal for outputting said first signal, said second signal and said third signal.

43. An ink jet printing device comprising:

an ink jet print head comprising:

pressure generating chambers, each of said pressure generating chambers having a Helmholtz resonance frequency of period TH and communicating with a common ink chamber via an ink supply path;

nozzle holes respectively corresponding to said pressure generating chambers; and piezoelectric vibrators for expanding and compressing said pressure generating chambers, respectively;

drive signal generating means, connected to said piezoelectric vibrators, for generating a first signal to expand said pressure generating chambers for a time substantially equal to said period TH of said Helmholtz resonance frequency, a second signal for compressing said pressure generating chambers, each being in an expanded state, to jet out ink droplets from respective nozzle holes after a predetermined time from the output of said first signal, and a third signal, for expanding said pressure generating chambers by a volume smaller than a volume produced in response to said first signal, at a time when a meniscus generated after jetting out each ink droplet moves toward an associated nozzle hole; and means for adjusting a ratio of the amplitudes of said first signal and said third signal.

44. The ink jet printing device according to claim 43, wherein said ratio is adjusted by an active state time duration of said third signal.

45. The ink jet printing device according to claim 43, wherein an active state time duration of said third signal is substantially equal to an active state time duration of said second signal.

46. The ink jet printing device according to claim 43, further comprising:

a control signal generating means for generating a latch signal, a print signal and a shift clock signal;

a plurality of first flip-flops, respectively corresponding to said piezoelectric vibrators, which receive said shift clock signal and said print signal, each of said plurality of first flip-flops outputting a print signal;

a plurality of second flip-flops, respectively coupled to said piezoelectric vibrators, each of said second flip-flops receiving said print signal from an associated one of said first flip-flops and further receiving said latch signal; each of said second flip-flops outputting a is control signal; and a plurality of switching transistors each receiving said control signal output by an associated one of said second flip-flops for controlling activation of respective ones of said piezoelectric vibrators;

wherein said first flip-flops form a shift register and said second flip-flops form a latch circuit such that said print signals from said first flip-flops are latched by said second flip-flops, respectively.

47. The ink jet printing device according to claim 46, further comprising:

a plurality of OR gates connected to said drive signal generating means and to respective ones of said second flip-flops, wherein said switching transistors are selectively activated by output signals from said OR gates.

48. The ink jet printing device according to claim 43, wherein said drive signal generating means comprises:

a timing control circuit;

charging means connected to said timing control circuit;

discharging means connected to said timing control circuit;

a capacitor connected to both said charging means and said discharging means; and an output terminal for outputting said first signal, said second signal and said third signal.

49. An ink jet printing device comprising:

an ink jet print head comprising:

pressure generating chambers, each of said pressure generating chambers having a Helmholtz resonance frequency of period TH and communicating with a common ink chamber via an ink supply path;

nozzle holes respectively corresponding to said pressure generating chambers; and piezoelectric vibrators for expanding and compressing said pressure generating chambers, respectively;

drive signal generating means, connected to said piezoelectric vibrators, for generating a first signal to expand said pressure generating chambers, a second signal for compressing said pressure generating chambers, each being in an expanded state, to jet out ink droplets from respective nozzle holes after a predetermined time from the output of said first signal, and a third signal, for expanding said pressure generating chambers by a volume smaller than a volume produced in response to said first signal, at a time when a meniscus generated after jetting out each ink droplet moves toward an associated nozzle hole; and means for adjusting a time period between termination of supply of said second signal to initiation of supply of said third signal.

50. The ink jet printing device according to claim 49, wherein the amplitude of said third signal is 0.2 to 0.4 times the amplitude of said second signal.

51. The ink jet printing device according to claim 49, wherein an active state time duration of said third signal is shorter than said period TH of said Helmholtz resonance frequency.

52. The ink jet printing device according to claim 49, wherein an active state time duration of said third signal is substantially equal to an active state time duration of said second signal.

53. The ink jet printing device according to claim 49, wherein a time difference from an output of said second signal to an output of said third signal is substantially equal to said period TH of said Helmholtz resonance frequency.

54. The ink jet printing device according to clam 49, wherein an active state time duration of said second signal is substantially equal to the period of natural vibration of said piezoelectric vibrators.

55. The ink jet printing device according to claim 49, wherein an active state time duration of said third signal is substantially equal to the period of natural vibration of said piezoelectric vibrators.

56. The ink jet printing device according to claim 49, wherein output timing of said third signal is controlled in accordance with ambient temperature.

57. The ink jet printing device according to claim 49, wherein output timing of said third signal is controlled in accordance with ambient temperature so that said output timing coincides with a timing when vibration of said meniscus in each nozzle hole moves to a position closest to an associated one of said pressure generating chambers.

58. The ink jet printing device according to claim 49, further comprising:

a control signal generating means for generating a latch signal, a print signal and a shift clock signal;

a plurality of first flip-flops, respectively corresponding to said piezoelectric vibrators, which receive said shift clock signal and said print signal, each of said plurality of first flip-flops outputting a print signal;

a plurality of second flip-flops, respectively coupled to said piezoelectric vibrators, each of said second flip-flops receiving said print signal from an associated one of said first flip-flops and further receiving said latch signal; each of said second flip-flops outputting a control signal; and a plurality of switching transistors each receiving said control signal output by an associated one of said second flip-flops for controlling activation of respective ones of said piezoelectric vibrators;

wherein said first flip-flops form a shift register and said second flip-flops form a latch circuit such that said print signals from said first flip-flops are latched by said second flip-flops, respectively.

59. The ink jet printing device according to claim 58, further comprising:

a plurality of OR gates connected to said drive signal generating means and to respective ones of said second flip-flops, wherein said switching transistors are selectively activated by output signals from said OR gates.

60. The ink jet printing device according to claim 49, wherein said drive signal generating means comprises:

a timing control circuit;

a temperature detecting means connected to said timing circuit;

charging means connected to said timing control circuit;

discharging means connected to said timing control circuit;

a capacitor connected to both said charging means and said discharging means; and an output terminal for outputting said first signal, said second signal and said third signal.

61. An ink jet printing device comprising:

an ink jet print head comprising:

pressure generating chambers, each of said pressure generating chambers communicating with a common ink chamber via an ink supply path;

nozzle holes respectively corresponding to said pressure generating chambers; and piezoelectric vibrators for expanding and compressing said pressure generating chambers, respectively;

drive signal generating means, connected to said piezoelectric vibrators, for generating a first signal to expand said pressure generating chambers, a second signal for compressing said pressure generating chambers, each being in an expanded state, to jet out ink droplets from respective nozzle holes after a predetermined time from the output of said first signal, and a third signal, for expanding said pressure generating chambers by a volume smaller than a volume produced in response to said first signal, at a time when a meniscus generated after jetting out each ink droplet moves toward an associated nozzle hole; and temperature adjustment means responsive to said drive signal generating means for adjusting an amplitude of said second signal relative to a reference signal based on a detected environmental temperature supplied by said drive signal generating means.

62. The ink jet printing device according to claim 61, wherein said temperature adjustment means adjusts the amplitude of said second signal to a value higher than said reference signal when the detected environmental temperature is lower than a reference temperature, and wherein said temperature adjustment means adjusts the amplitude of said second signal to a value lower than said reference signal when the detected environmental temperature is higher than the reference temperature.

63. The ink jet printing device according to claim 61, further comprising:

a control signal generating means for generating a latch signal, a print signal and a shift clock signal;

a plurality of first flip-flops, respectively corresponding to said piezoelectric vibrators, which receive said shift clock signal and said print signal, each of said plurality of first flip-flops outputting a print signal;

a plurality of second flip-flops, respectively coupled to said piezoelectric vibrators, each of said second flip-flops receiving said print signal from an associated one of said first flip-flops and further receiving said latch signal; each of said second flip-flops outputting a control signal; and a plurality of switching transistors each receiving said control signal output by an associated one of said second flip-flops for controlling activation of respective ones of said piezoelectric vibrators;

wherein said first flip-flops form a shift register and said second flip-flops form a latch circuit such that said print signals from said first flip-flops are latched by said second flip-flops, respectively.

64. The ink jet printing device according to claim 61, further comprising:

a plurality of OR gates connected to said drive signal generating means and to respective ones of said second flip-flops, wherein said switching transistors are selectively activated by output signals from said OR gates.

65. The ink jet printing device according to claim 61, wherein said drive signal generating means comprises:

a timing control circuit;

a temperature detecting means connected to said timing circuit for supplying the detected environmental temperature to said temperature adjustment means;

charging means connected to said timing control circuit;

discharging means connected to said timing control circuit;

a capacitor connected to both said charging means and said discharging means; and an output terminal for outputting said first signal, said second signal and said third signal.

66. The ink jet printing device according to claim 61, wherein each of said pressure generating chambers has a Helmholtz resonance frequency of period TH, and wherein drive signal generating means generates said first signal to expand said pressure generating chambers for a time substantially equal to said period TH of said Helmholtz resonance frequency.

* * * * *